US009297140B2

(12) United States Patent
Hren et al.

(10) Patent No.: US 9,297,140 B2
(45) Date of Patent: Mar. 29, 2016

(54) ROPE SHOVEL

(71) Applicant: Harnischfeger Technologies, Inc., Wilmington, DE (US)

(72) Inventors: William J. Hren, Wauwatosa, WI (US); James M. Hutsick, Racine, WI (US); Patrick M. Severson, Milwaukee, WI (US); Samuel F. Haworth, Oak Creek, WI (US); Jason Knuth, Brookfield, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 27 days.

(21) Appl. No.: 14/033,423

(22) Filed: Sep. 20, 2013

(65) Prior Publication Data

US 2014/0037414 A1 Feb. 6, 2014

Related U.S. Application Data

(63) Continuation-in-part of application No. 13/363,053, filed on Jan. 31, 2012, now Pat. No. 8,756,839.

(60) Provisional application No. 61/438,458, filed on Feb. 1, 2011, provisional application No. 61/704,078, filed on Sep. 21, 2012, provisional application No. 61/777,697, filed on Mar. 12, 2013.

(51) Int. Cl.

| | |
|---|---|
| ***E02F 3/30*** | (2006.01) |
| ***E02F 9/14*** | (2006.01) |
| ***E21C 27/30*** | (2006.01) |
| ***E02F 3/38*** | (2006.01) |

(52) U.S. Cl.

CPC . *E02F 3/308* (2013.01); *E02F 3/38* (2013.01); *E02F 9/14* (2013.01); *E21C 27/30* (2013.01)

(58) Field of Classification Search

USPC ..... 37/394–401; 212/199, 255, 260, 261, 212/347; 414/685, 686

See application file for complete search history.

(56) References Cited

U.S. PATENT DOCUMENTS

| | | | | | |
|---|---|---|---|---|---|
| 226,874 | A | * | 4/1880 | Osgood | 37/395 |
| 1,369,165 | A | * | 2/1921 | Cochran et al. | 414/494 |
| 1,560,895 | A | * | 11/1925 | Crowe | 37/396 |
| 1,747,946 | A | * | 2/1930 | Mitchell et al. | 212/293 |

(Continued)

FOREIGN PATENT DOCUMENTS

| | | |
|---|---|---|
| CN | 1166558 | 12/1997 |

OTHER PUBLICATIONS

Engineering and Mining Journal Cover, Sep. 2009.012.

(Continued)

*Primary Examiner* — Matthew D Troutman

(74) *Attorney, Agent, or Firm* — Michael Best & Friedrich LLP

(57) ABSTRACT

A mining shovel includes a base for supporting the shovel on a support surface, a boom, an elongated member movably coupled to the boom, and a support member. The boom includes a first end pivotably coupled to the base and a second end positioned away from the base, the boom being pivotable about a boom pivot axis extending transversely to the boom proximate the first end. The elongated member is pivotable about a shaft positioned between the first end and the second end of the boom. The support member biases the boom against pivoting movement about the boom pivot axis, and the support member extends between the base and the boom.

39 Claims, 18 Drawing Sheets

(56) References Cited

U.S. PATENT DOCUMENTS

| | | | | | |
|---|---|---|---|---|---|
| 1,797,224 | A | | 3/1931 | Brey | |
| 1,813,110 | A | | 7/1931 | Bauer | |
| 1,817,905 | A | * | 8/1931 | Bager et al. | 212/195 |
| 1,905,191 | A | | 4/1933 | Snow, Jr. | |
| 2,191,696 | A | * | 2/1940 | Jacoby et al. | 37/395 |
| 2,200,315 | A | * | 5/1940 | Weimer | 37/396 |
| 2,762,141 | A | * | 9/1956 | Le Tourneau | 37/190 |
| 2,820,561 | A | * | 1/1958 | Meagher | 414/607 |
| 2,911,111 | A | * | 11/1959 | Grove | 212/349 |
| 3,049,252 | A | | 8/1962 | Noll | |
| 3,184,085 | A | | 5/1965 | Randall et al. | |
| 3,843,095 | A | * | 10/1974 | Rupert | 74/89.22 |
| 3,863,786 | A | * | 2/1975 | Frank | 414/686 |
| 3,877,581 | A | * | 4/1975 | Auxer | 212/195 |
| 3,933,260 | A | | 1/1976 | Kronlokken et al. | |
| 4,167,072 | A | | 9/1979 | Johansson | |
| 4,469,594 | A | | 9/1984 | Poetter | |
| 5,822,892 | A | * | 10/1998 | Ohbatake et al. | 37/397 |
| 6,401,370 | B1 | * | 6/2002 | Blom et al. | 37/396 |
| 6,434,862 | B1 | | 8/2002 | Hren | |
| 7,024,806 | B2 | * | 4/2006 | Suzik et al. | 37/396 |
| 7,685,749 | B2 | * | 3/2010 | Loeffelholz et al. | 37/398 |
| 8,297,906 | B2 | | 10/2012 | Nabata et al. | |
| 8,756,839 | B2 | | 6/2014 | Hren et al. | |
| 2005/0150141 | A1 | * | 7/2005 | Suzik et al. | 37/395 |
| 2007/0266601 | A1 | * | 11/2007 | Claxton | 37/396 |
| 2010/0193308 | A1 | * | 8/2010 | Nowaczyk et al. | 188/297 |
| 2011/0214317 | A1 | * | 9/2011 | Wurster | 37/397 |
| 2011/0296721 | A1 | * | 12/2011 | Ries et al. | 37/395 |
| 2012/0195729 | A1 | | 8/2012 | Hern et al. | |
| 2014/0227071 | A1 | * | 8/2014 | Maki et al. | 414/685 |
| 2014/0294550 | A1 | | 10/2014 | Hren et al. | |

OTHER PUBLICATIONS

Notification of First Office Action from the State Intellectual Property Office of the People's Republic of China for Chinese Application No. 201320587719.0 dated Jan. 28, 2014 (1 page).

Notification of First Office Action with English Translation of the State Intellectual Property Office of The People's Republic of China for Application No. 201210022625.9 dated Mar. 2, 2015 (14 pages).

* cited by examiner

ROPE SHOVEL

CROSS REFERENCE TO RELATED APPLICATIONS

This application is a continuation-in-part of co-pending U.S. patent application Ser. No. 13/363,053, filed Jan. 31, 2012, which claims the benefit of and priority to U.S. Provisional Patent Application No. 61/438,458, filed Feb. 1, 2011, and this application claims the benefit of and priority to U.S. Provisional Patent Application No. 61/704,078, filed Sep. 21, 2012, and U.S. Provisional Patent Application No. 61/777,697, filed Mar. 12, 2013, the entire contents of all of which are hereby incorporated by reference herein.

BACKGROUND

The present invention relates to rope shovels used for example in the mining and the construction industries.

In the mining field, and in other fields in which large volumes of materials must be collected and removed from a work site, it is typical to employ a power shovel including a large dipper for shoveling material from the work site. After filling the dipper with material, the shovel swings the dipper to the side to dump the material into a material handling unit, such as a dump truck or a local handling unit (e.g., crusher, sizer, or conveyor). Generally, the shovels used in the industry include hydraulic shovels and electric rope shovels. Electric rope shovels typically include a shovel boom that supports a pulling mechanism that pulls the shovel dipper thereby producing efficient dig force to excavate the bank of material. Conventional electric rope shovels include a relatively straight boom that is mounted at forty five degrees with respect to a horizontal plane (e.g., the ground).

SUMMARY

In some aspects, the invention provides a digging assembly for a mining shovel. The assembly includes a generally V-shaped boom including a lower connection point for attachment to the mining shovel. A first portion of the boom extends generally upwardly from the lower connection point, and a second portion of the boom is angled with respect to and extends upwardly and forwardly from the first portion. The second portion includes a distal end defining a sheave support, and a pivot element is positioned generally at a connection area between the first portion and the second portion. The assembly also includes a boom attachment (also known as a boom handle) having a first end that is pivotally supported by the pivot element and a second end that is connected to a dipper.

In other aspects, the invention provides a digging assembly for a mining shovel. The assembly includes a generally V-shaped boom including a lower connection point for attachment to the mining shovel. A first portion of the boom extends generally upwardly from the lower connection point, and a second portion of the boom is angled with respect to and extends upwardly and forwardly from the first portion. The second portion includes a distal end defining a sheave support, and a pivot element is positioned between about zero degrees and about 10 degrees from a vertical line extended directly upwardly from the lower connection point. The assembly also includes a boom attachment having a first end that is pivotally supported by the pivot element and a second end that is connected to a dipper.

In still other aspects, the invention provides a mining shovel that includes a lower base and an upper base rotatably mounted on the lower base for rotation relative to the lower base. A generally V-shaped boom includes a lower connection point for attachment to the upper base, a first portion extending generally upwardly from the lower connection point, and a second portion angled with respect to and extending upwardly and forwardly from the first portion. The second portion includes a distal end defining a sheave support. A pivot element is positioned generally at a connection area between the first portion and the second portion. A sheave is rotatably supported by the sheave support. A boom attachment has a first end that is pivotally supported by the pivot element and a second end that is connected to a dipper. A rope extends from the upper base, over the sheave, and is connected to the dipper for support thereof.

In still other aspects, the invention provides a mining shovel that includes a lower base and an upper base rotatably mounted on the lower base for rotation relative to the lower base. A generally V-shaped boom includes a lower connection point for attachment to the upper base, a first portion extending generally upwardly from the lower connection point, and a second portion angled with respect to and extending upwardly and forwardly from the first portion. The second portion includes a distal end defining a sheave support. A pivot element is positioned between about zero degrees and about 10 degrees from a vertical line extended directly upwardly from the lower connection point. A sheave is rotatably supported by the sheave support. A boom attachment has a first end that is pivotally supported by the pivot element and a second end connected to a dipper. A rope extends from the upper base, over the sheave, and is connected to the dipper for support thereof.

In still other aspects, the invention provides a mining shovel that includes a flat bottom boom and a strut mechanism for supporting the boom in an upright position relative to a base of the shovel.

In still other aspects, the invention provides a mining shovel including a base, a boom, an elongated member movably coupled to the boom, and a support member. The base includes a first portion and a second portion. The first portion includes tracks for supporting the shovel on a support surface, and the second portion is rotatable relative to the first portion about an axis of rotation. The boom includes a first end pivotably coupled to the second portion of the base and a second end positioned away from the base. The boom is pivotable about a pivot axis extending transversely to the boom proximate the first end. The elongated member is pivotable relative to the boom. The support member biases the boom against pivoting movement about the pivot axis. The support member includes a pair of struts. Each strut is positioned on an opposite side of the axis of rotation and includes a first end coupled to the second portion of the base and a second end coupled to the boom.

In still other aspects, the invention provides a support member for a mining shovel including a base and a boom. The base has a first portion and a second portion supported for rotation relative to the first portion about a rotational axis. The boom has a first end pivotably coupled to the second portion. The support member includes a strut and a damper for dampening a pivoting movement of the boom relative to the second portion of the base. The strut includes a first end and a second end. The first end is adapted to be coupled to the boom, and the second end is adapted to be coupled to the second portion of the base. The damper includes a first end coupled to the strut and a second end adapted to be coupled to the boom.

In still other aspects, the invention provides a mining shovel including a base for supporting the shovel on a support surface, a boom, an elongated member movably coupled to the boom, and a support member. The boom includes a first end pivotably coupled to the base and a second end positioned away from the base. The boom is pivotable about a pivot axis extending transversely to the boom proximate the first end. The elongated member is pivotable about a shaft positioned between the first end and the second end of the boom. The support member biases the boom against pivoting movement about the pivot axis. The support member extending between the base and the boom.

Other aspects of the invention will become apparent by consideration of the detailed description and accompanying drawings.

Figure 1:
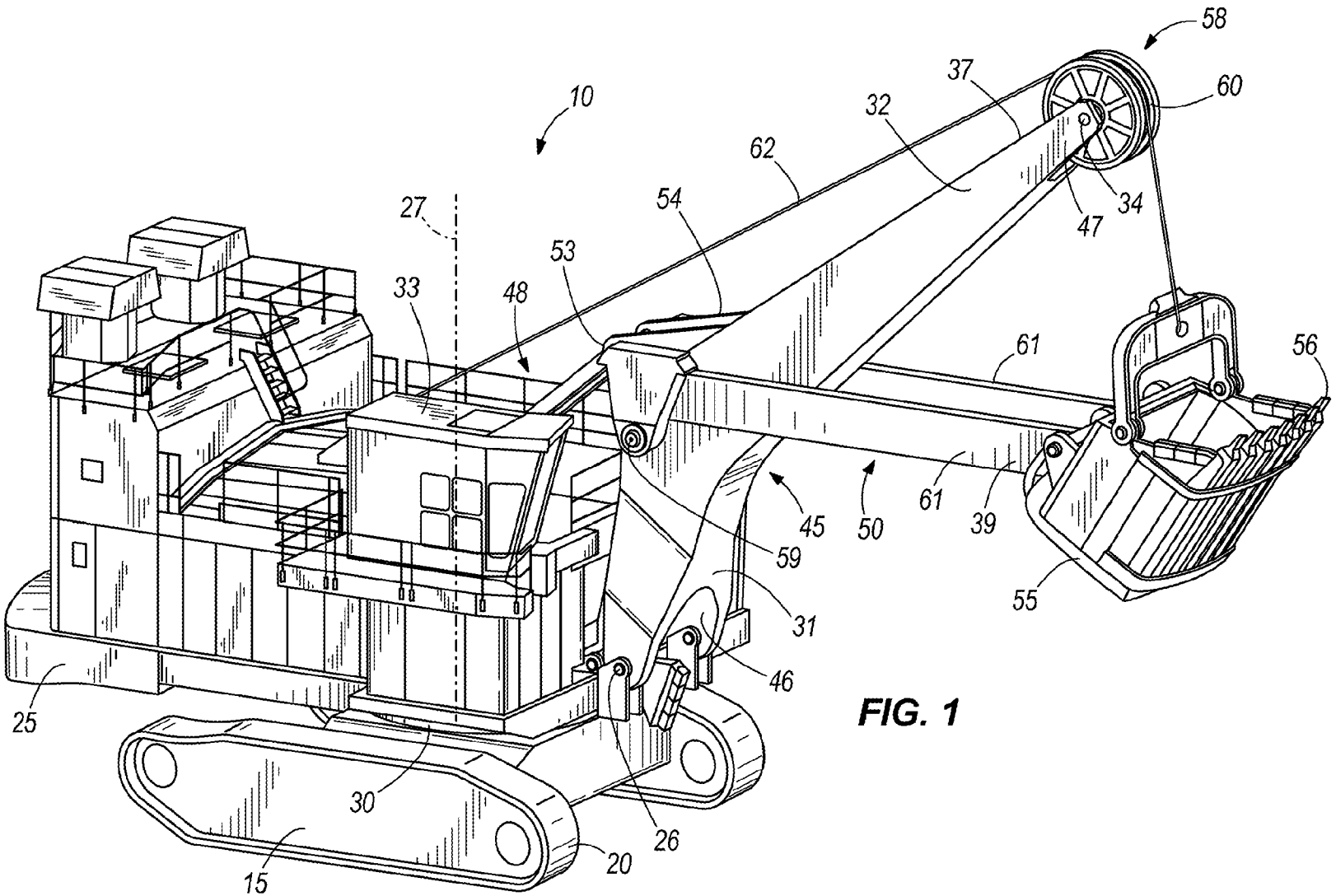
FIG. 1 is a perspective view of an electric rope shovel.

It is to be understood that the invention is not limited in its application to the details of the construction and the arrangements of components set forth in the following description or illustrated in the drawings. The present invention is capable of other embodiments and of being practiced or being carried out in various ways. Also, it is to be understood that the phraseology and terminology used herein is for the purpose of description and should not be regarded as limiting.

DETAILED DESCRIPTION

Figure 2:
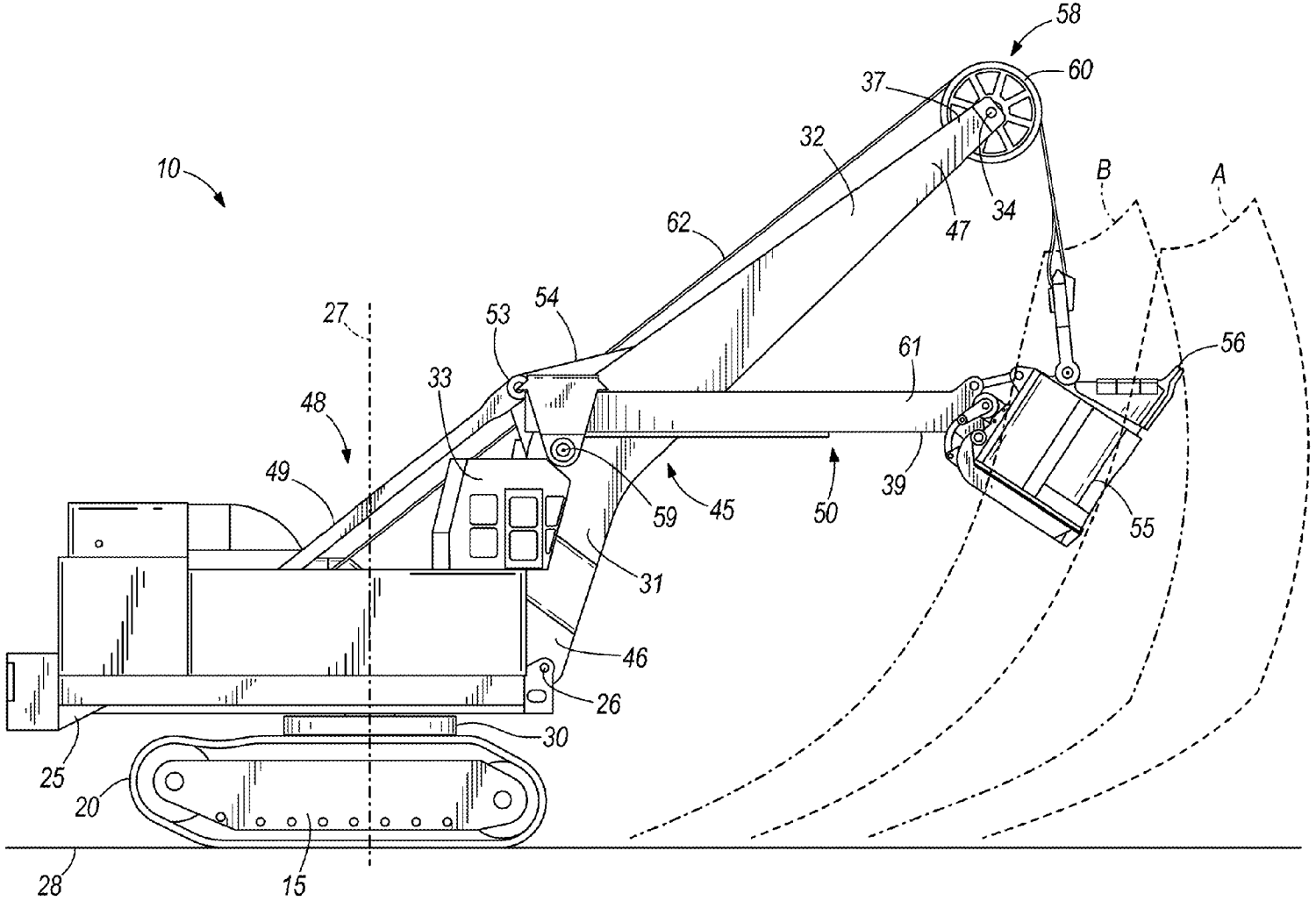
FIG. 2 is a side view of the electric rope shovel of FIG. 1 with some portions removed and showing a reach comparison between a conventional boom A and a curved boom B.
Figure 3:
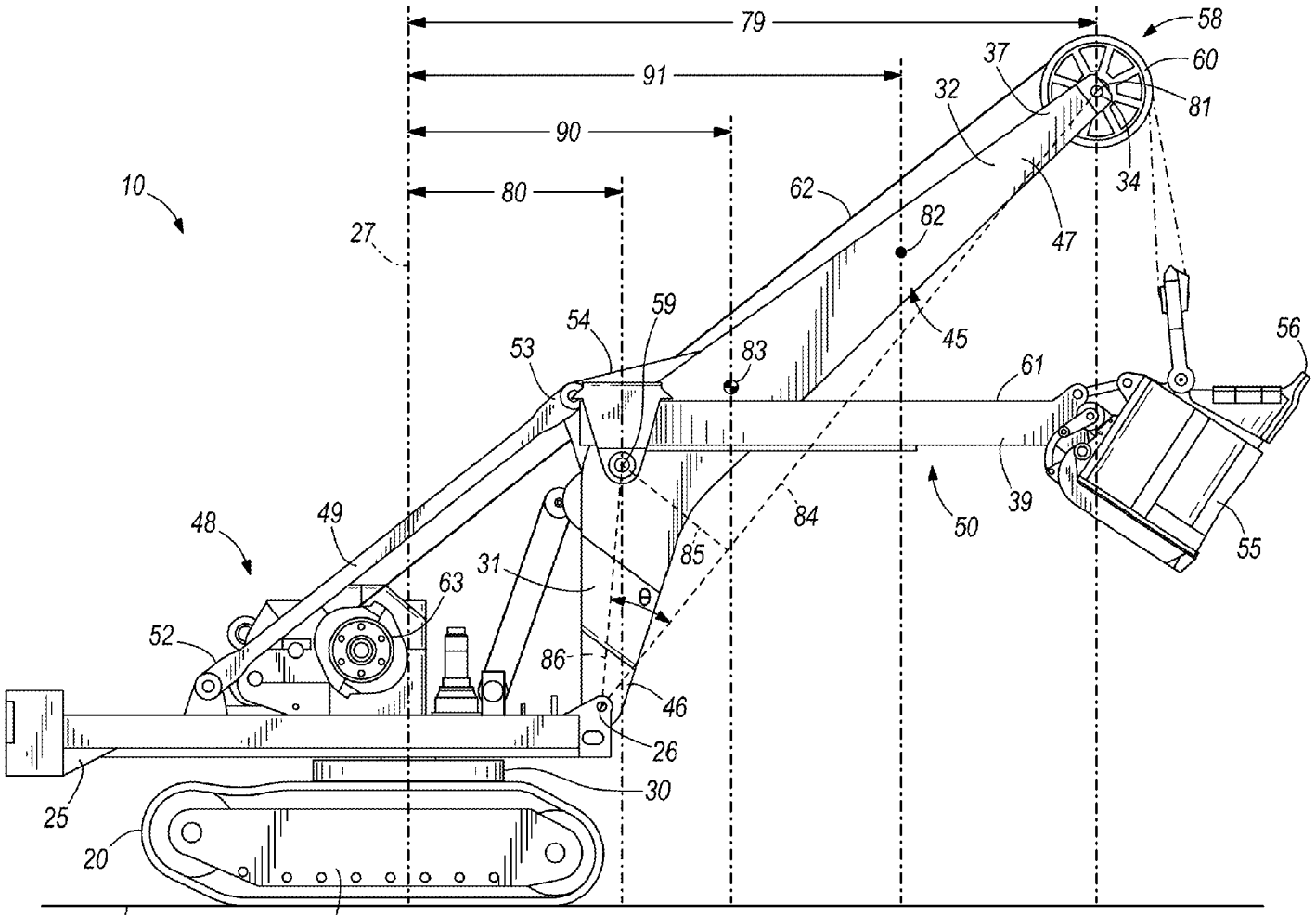
FIG. 3 is a side view of the electric rope shovel of FIG. 1 with additional portions removed and illustrating relative locations of the centers of gravity of certain components of the shovel.
Figure 4:
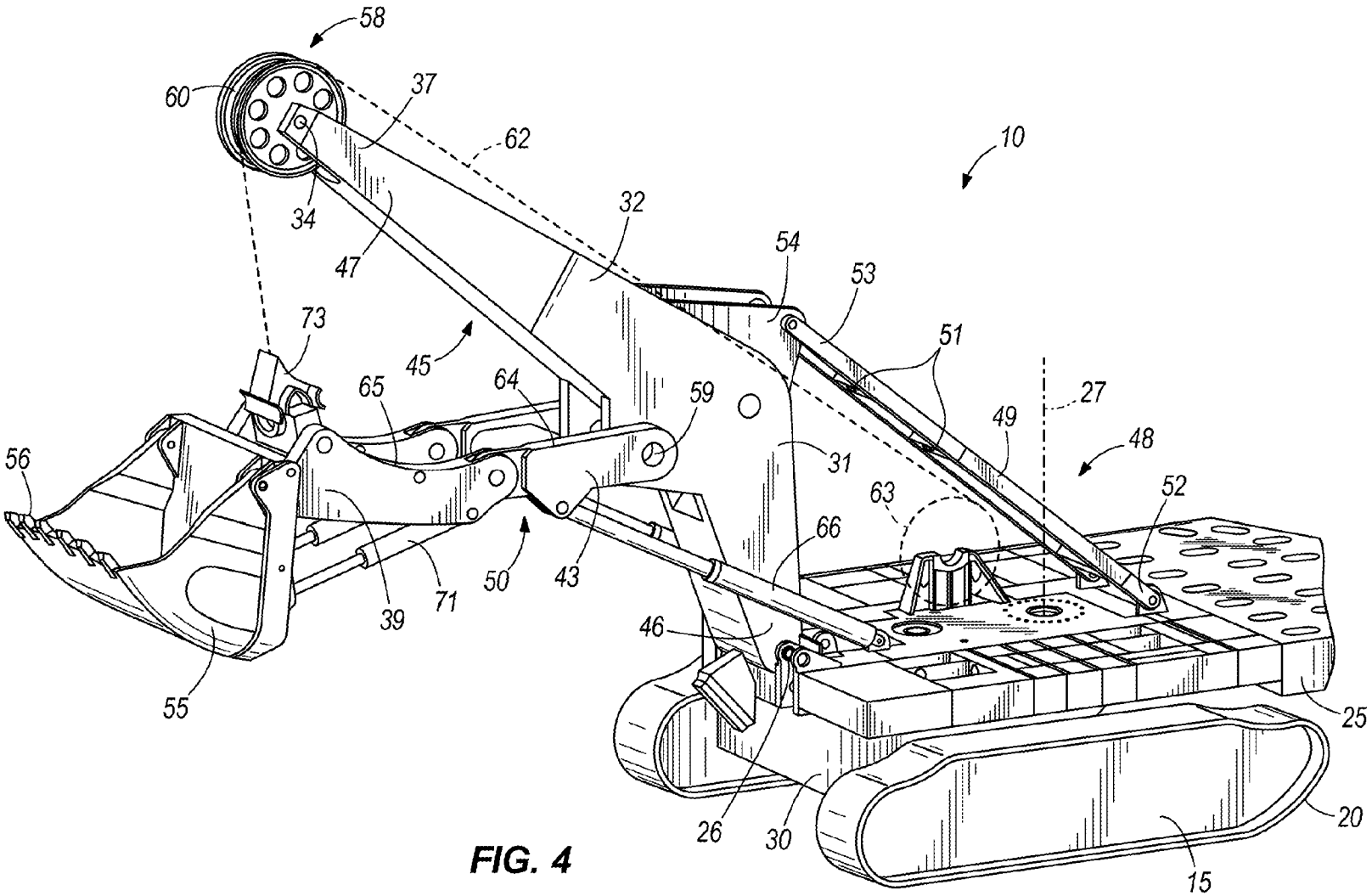
FIG. 4 is a perspective view of a rope shovel according to another embodiment.

FIGS. 1-4 illustrate an electric rope shovel 10 including a lower base 15 that is supported on drive tracks 20. The electric shovel 10 further includes an upper base 25 (also called a deck) positioned on a rotational structure 30 that is mounted to the lower base 15. The rotational structure 30 allows rotation of the upper base 25 relative to the lower base 15. The rotational structure defines a center line of rotation 27 of the shovel 10 (FIG. 4). The center line of rotation 27 is perpendicular to a plane 28 defined by the lower base 15 and generally corresponding to the grade of the ground. In one embodiment, the upper base 25 includes, among other elements, an operating area 33 used by an operator or a driver to operate the electric rope shovel 10. As used herein, the terms "above," "upwardly," "vertically," and the like assume the drive tracks 20 are positioned on level ground such that the center line of rotation 27 is substantially vertical.

The electric rope shovel 10 further includes a boom 45 extending upwardly from the upper base 25. The boom 45 includes a first end 46 coupled to the upper base 25 and a second end 47. The boom 45 is curved and has "banana" or a "V" shape. The boom 45 is coupled to the upper base 25 at a point 26 via pin joints or other suitable attachment mechanisms. In some embodiments, the boom 45 comprises a generally vertical first portion 31 that extends generally upwardly from the base 25, and a second portion 32 that extends at an angle from the first portion 31 toward the second end 47. The second end 47 of the boom 45 is remote from the base 25. In one embodiment, the boom 45 comprises a one-piece construction combining the first and the second portions of the boom. In other embodiments, the boom 45 comprises two pieces, where the two portions of the boom 45 are securely attached to one another via welding, pin joints, fasteners, or any other attachment mechanisms.

The first portion 31 of the boom 45 is angled with respect to the second portion 32 of the boom. In some embodiments, the angle between the first portion 31 and the second portion 32 of the boom can be between about one hundred and twenty degrees and about one hundred and sixty degrees. More specifically, the angle between the first portion 31 and the second portion 32 can be between approximately one hundred and sixty degrees. In other words, the second portion 32 of the boom 45 is offset between abut twenty and about sixty degrees from the first portion 31 of the boom 45. In particular, the offset between the second portion 32 of the boom 45 and the first portion 31 can be twenty degrees.

The electric rope shovel 10 also includes a digging attachment comprising a boom attachment 50 (also called a boom handle) pivotally and slidably coupled to the boom 45 and a dipper 55 rigidly coupled to an end 39 of the boom attachment 50. In other embodiments, the dipper 55 can be moveably (e.g., pivotally) attached to the boom handle 50. Together the boom 45, the boom attachment 50, and the dipper 55 define a digging assembly of the shovel 10. The dipper 55 includes dipper teeth 56 and is used to excavate the desired work area, collect material, and transfer the collected material to a desired location (e.g., a material handling vehicle).

A pulling mechanism 58 is mounted on a second end 47 of the boom 45 and partially supports the boom handle 50 and the dipper 55. In some embodiments, the pulling mechanism 58 comprises a pulley or boom sheave 60 and a flexible hoist rope 62 that extends from the base 25, upwardly along the boom 45 and over the boom sheave 60, and downwardly to an attachment point on the dipper 55. The flexible hoist rope 62 is wrapped around a hoist drum 63 mounted on the upper base 25 of the electric shovel 10. The hoist drum 63 is powered by an electric motor (not shown) that provides turning torque to the drum 63 through a geared hoist transmission (not shown).

The sheave 60 is rotatably coupled to the second end 47 of the boom 45 between a pair of sheave support members 37 located at the second end 47 of the boom 45. A rod or a load pin 34 extends between the sheave support members 37 and through the sheave 60, thereby rotatably coupling the sheave 60 to the boom 45. Thus, the sheave 60 rotates about the rod or the load pin 34. In other embodiments, alternative mechanisms for connecting the sheave 60 to the boom 45 can be used. Rotation of the hoist drum 63 reels in and pays out the hoist rope 62, which travels over the sheave 60 and raises and lowers the dipper 55.

The electric shovel 10 also includes a strut mechanism 48 for supporting the boom 45 in an upright position relative to the base 25. In one embodiment, the strut 48 includes two parallel strut legs 49 coupled by rigid-connect members 51. One end 52 of the strut 48 is rigidly mounted on the base 25 at a location spaced apart from the first end 46 of the boom 45. A second end 53 of the strut 48 is coupled to the boom 45 by connecting each strut leg 49 to a depending portion 54 of the boom 45. In some embodiments, the second end 53 of the strut 48 is coupled to the general area where the first portion 31 and the second portion 32 of the boom 45 connect or intersect. The strut 48 supports the boom 45 in the upright position. The strut 48 of the shovel 10 allows the elimination of a major structural member used in a conventional shovel (i.e., the gantry structure) and the suspension ropes also used in a conventional shovel.

In some embodiments, the strut 48 is pivotally connected to the base 25 and to the boom 45 via moving pin joints or other types of connectors. The strut 48 can be provided with shock absorbing connectors (FIG. 11, described below)—such as various types of spring assemblies and/or fluid dampers incorporated into the pinned attachment joints between the strut 48, the base 25, and the boom 45. These shock absorbing connectors can reduce the overall stiffness of the strut assembly when compression and tension forces are acting on the strut, thereby reducing shock loading and in turn reducing the overall stresses experienced by the various components and the major structures.

The curved boom 45 can be used with a variety of differently configured boom handles 50. For example, in the embodiments of FIGS. 1-3 the boom handle 50 includes two substantially straight and parallel elongated handle members 61 positioned on either side of the boom 45. On the other hand, in the embodiment of FIG. 4, the boom handle 50 includes an upper arm 64 and a lower arm 65. The upper arm 64, and consequently the boom handle 50, is pivotally attached to a portion of the boom 45 generally where the first portion 31 and the second portion 32 of the boom 45 connect or intersect. In the illustrated embodiment, the upper arm 64 includes parallel upper arm members 43, such that one upper arm member 43 extends to each side of the boom 45. The lower arm 65 of the boom handle 50 is mechanically connected to the upper arm 64, and is driven by the upper arm 64. In some embodiments, the lower arm 65 is connected to the upper arm 64 via free moving pin joints, but other mechanical connections such as cams, linkages, gear sets, and the like may also be used to achieve the desired relative movement between the upper arm 64 and the lower arm 65.

With continued reference to the embodiment of FIG. 4, the boom handle 50 is driven by one or more hydraulic cylinders 66 that extend between at least one of the upper arm 64 and the lower arm 65 and at least one of the boom 45 and the base 25. In the illustrated construction, two hydraulic cylinders 66 are used, with one cylinder 66 positioned on each side of the boom 45. The hydraulic cylinders 66 pivot the upper arm 64 with respect to the boom 45 and thrust the lower arm 65 and the dipper 55 into the bank of material that is being excavated. The dipper 55 is moveably (e.g., pivotally) connected to the distal end of the lower arm 65. At least one actuator 71 in the form of a hydraulic cylinder extends between the dipper 55 and the lower arm 65 and is operable to move the dipper 55 relative to the lower arm. Other types of actuators can be used and can alternatively be coupled to the upper arm 64 or to an intermediate structure (not shown) coupled to one or both of the upper arm 64 and the lower arm 65.

Regardless of whether the shovel has the boom attachment 50 of FIGS. 1-3 or the boom attachment 50 of FIG. 4, the boom attachment 50 is also supported by the sheave 60 via the hoist rope 62. For that purpose, the boom attachment includes a connecting mechanism that engages the hoist rope 62 and connects the boom attachment with the sheave 60 (FIG. 4). In one embodiment, the connecting mechanism comprises an equalizer 73 coupled to the lower arm 65. In alternative embodiments (e.g., when the hydraulic cylinders driving the dipper are attached to the upper portion of the dipper), the equalizer 73 is positioned near the pivot point of the lower arm 65 and the dipper, and the hoist rope 62 passes between the actuators 71 to reach the equalizer. Where more than one hoist rope is used, the equalizer 73 can sense the tension applied on each hoist rope 62 and is operable to equalize the tension in the two hoist ropes 62. In other embodiments, different types of connecting mechanisms can be used to connect the sheave 60 and the boom attachment 50 and the dipper 55.

As shown in FIGS. 1-4, the boom 45 includes a pivot element or pivot point 59 (e.g., a shipper shaft or a pin depending on the type of boom handle 50) that pivotally supports the boom handle 50. The pivot point 59 of the curved boom 45 is located significantly closer to the center line of rotation 27 of the shovel 10 when compared to the pivot point location for a conventional straight boom. For example, in some embodiments, the pivot point 59 is about nine feet closer to the axis of rotation 27 that it would be if the boom 45 was a conventional straight boom. Thus, as shown in FIG. 2, the maximum reach of the dipper 10 (shown as B) is closer to the base and to the center line of rotation 27 when compared to the reach of the convectional dipper (shown as A). The center of gravity 83 of the curved boom 45 is also closer to the center line of rotation 27 than the center of gravity of a conventional boom. Consequently, less counterweight is required to support the digging attachment and the overall machine weight and swing inertia is reduced.

In some embodiments, the pivot point 59 of the boom handle is positioned approximately at the general area where the first portion 31 and the second portion 32 of the boom 45 connect or intersect. In some embodiments, the pivot point 59 is positioned substantially directly above the point of connection 26 between the first portion 31 of the boom 45 and the upper base 25. For example, depending on the particular construction of the boom, the pivot point 59 can be positioned between about zero degrees and about ten degrees from a vertical line drawn directly upwardly from the point of connection 26. In other embodiments, the pivot point 59 can be positioned between about zero degrees and about five degrees from a vertical line drawn upwardly from the point of connection 26.

Because of the curved shape of the boom 45, the pivot point 59 of the boom handle 45 is moved substantially towards the base 25 and the center line of rotation 27 of the shovel 10. The relationship of different points along the boom 45 relative to the axis of rotation 27 and relative to one another are illustrated in and discussed with respect to FIG. 3. The relevant points or locations along the boom 45 include the pivot point 59, the center of gravity 83 of the boom 45, a geometric center 82 of the second boom portion 32, and a pulley connection point 81 where the pulley 60 is rotatably coupled to the second boom portion 42. A pulley reference distance 79 is defined as the perpendicular distance from the axis of rotation 27 to the pulley connection point 81. A pivot point distance 80 is defined as the perpendicular distance from the axis of rotation 27 to the pivot point 59. A CG distance 90 is defined as the perpendicular distance from the axis of rotation 27 to the center of gravity 83 of the boom 45. A second portion center distance 91 is defined as the perpendicular distance from the axis of rotation 27 to the geometric center 82 of the second boom portion 32.

In some embodiments, the pivot point distance 80 is between about 20 percent and about 40 percent of the pulley reference distance 79. In other embodiments the pivot point distance 80 is between about 25 percent and about 35 percent of the pulley reference distance 79. In still other embodiments the pivot point distance 80 is about thirty percent of the pulley reference distance 79.

In some embodiments, the CG distance 90 is between about 35 percent and about 55 percent of the pulley reference distance 79. In other embodiments the CG distance 90 is between about 40 percent and about 50 percent of the pulley reference distance 79. In still other embodiments the CG distance 90 is about 45 percent of the pulley reference distance 79.

In some embodiments, the second portion center distance 91 is between about 55 percent and about 75 percent of the pulley reference distance 79. In other embodiments the second portion center distance 91 is between about 60 percent and about 70 percent of the pulley reference distance 79. In still other embodiments the second portion center distance 91 is about 65 percent of the pulley reference distance 79.

With continued reference to FIG. 3, reference line 84 extends between point 26 (i.e., the point of connection between the first portion 31 of the boom 45 and the upper base 25) and pulley connection point 81. Reference line 85 extends through the pivot point 59 and is perpendicular to reference line 84. In some embodiments, the length of reference line 85 is between about ¼ and about ⅛ of the length of reference line 84. In other embodiments the length of reference line 85 is between about ⅕ and about ⅐ of the length of reference line 84. In still other embodiments the length of reference line 85 is about ⅙ of the length of reference line 84.

Reference line 86 extends from point 26 to the pivot point 59. In some embodiments, an angle θ between reference line 86 and reference line 84 is greater than about 10 degrees. In other embodiments, the angle θ is greater than about 20 degrees. In still other embodiments, the angle θ is greater than about 30 degrees.

Thus, the features of the curved boom 45 help the shovel 10 to increase its dipper dig forces up to 15% compared to the shovel having a straight boom. Specifically, the height of the pivot point 58 in relation to the plane 28, the position of the pulley connection point 81 relative to the pivot point 59, and the length of the handle 50 help to increase the dipper dig forces. This increase in digging force and efficiency allows manufacturers to downsize the hoist motor and the drive train of the shovel, thereby lowering the cost of the shovel.

Due to the curved shape of the boom 45, the electric shovel 10 significantly improves the direct line of sight of the shovel operator who wants to view parked dump trucks as he or she swings the shovel to side opposite to the operator's area 33 (i.e., the operator's blind side). Compared to the conventional straight boom, the curved boom 45 is shifted above and behind the line of sight of the operator as he or she looks to target the truck bed with a full dipper in order to adjust the location of the dipper over the waiting truck bed. Further, the curved boom 45 opens up the area in front and below the boom for greater dipper accommodation in the tuck back areas.

FIGS. 5-9 illustrate a shovel 410 according to another embodiment. The shovel 410 includes components similar to the components of shovel 10 described above with respect to FIGS. 1-4, and similar features are indicated with similar reference numbers, plus 400.

Figure 5:
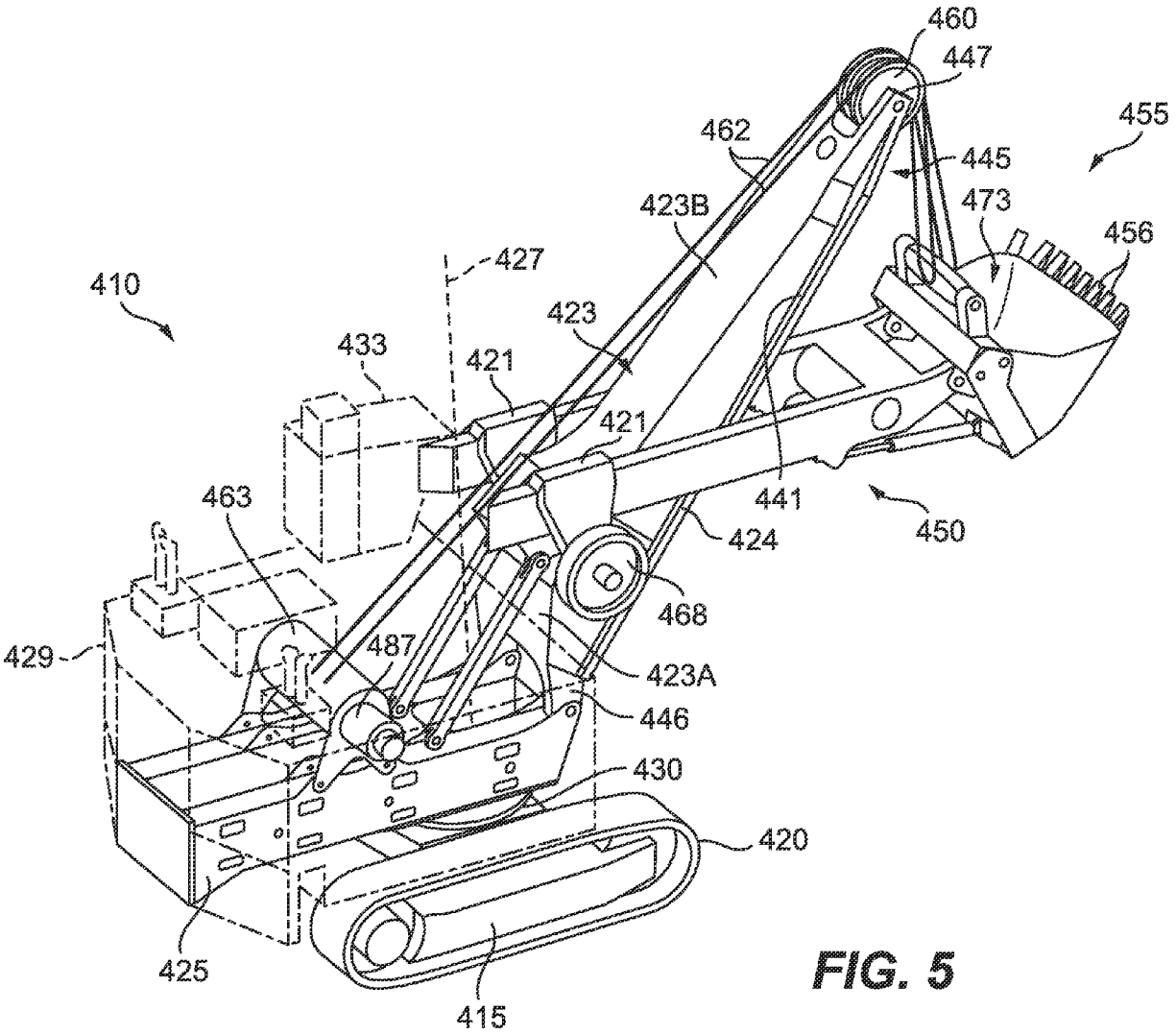
FIG. 5 is a perspective view of a shovel according to another embodiment.

As shown in FIG. 5, the shovel 410 includes a frame having a first portion or lower base 415 that is supported on drive tracks 420. The frame of the shovel 410 further includes a second portion or an upper base 425 (also called a deck) positioned on a rotational structure 430 that is mounted on the lower base 415. The rotational structure 430 allows rotation of the upper base 425 relative to the lower base 415. The rotational structure defines a center line or axis of rotation 427 of the shovel 410. The axis of rotation 427 is perpendicular to a plane 428 (FIG. 6) defined by the lower base 415 and generally corresponding to the grade of the ground or support surface. In one embodiment, the upper base 425 supports a machine house 429 including, among other elements, an operating area 433 used by an operator or a driver to operate the shovel 410. As used herein, the terms "above," "upwardly," "vertically," and the like assume the drive tracks 420 are positioned on level ground such that the axis of rotation 427 is substantially vertical.

Figure 6:
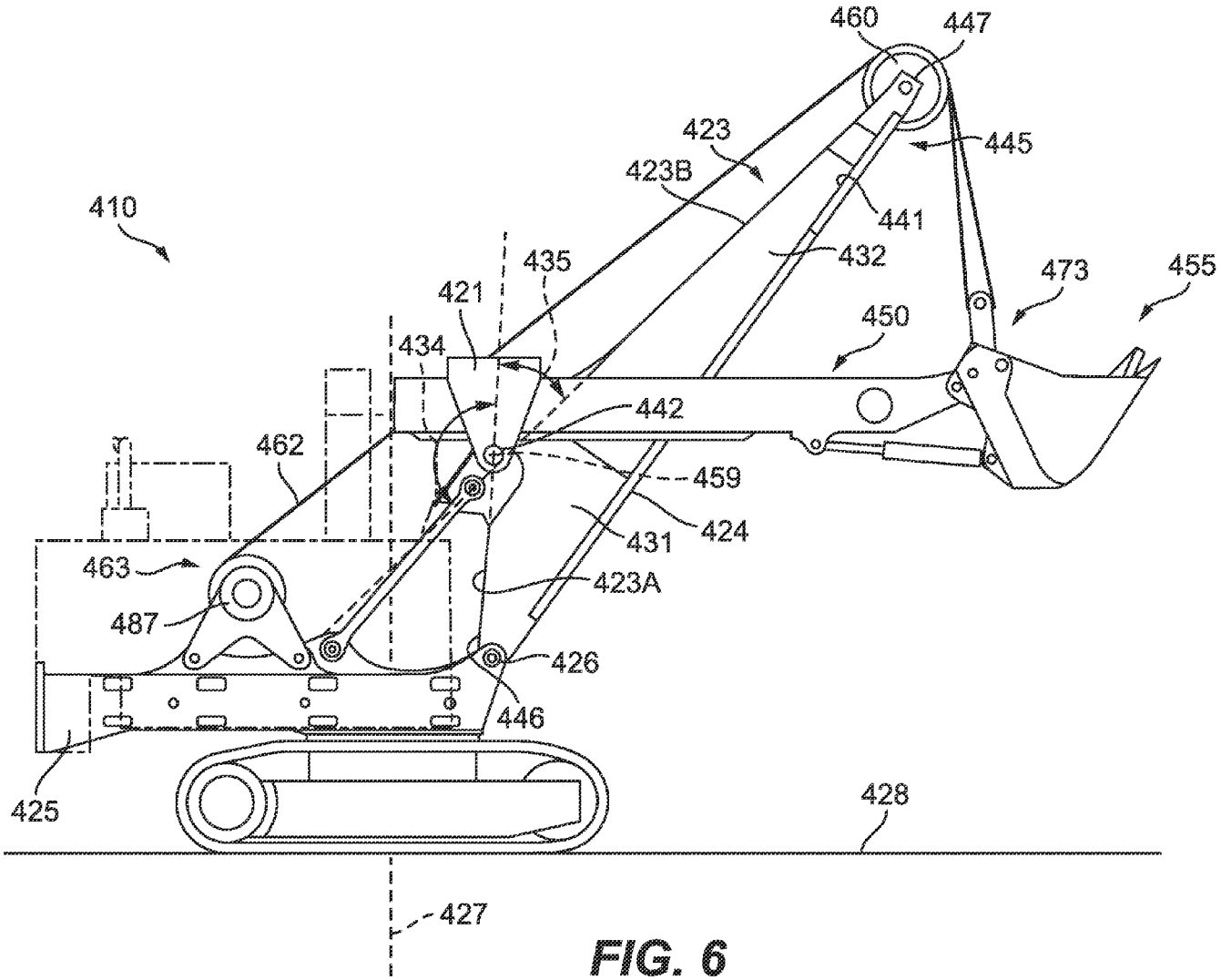
FIG. 6 is a side view of the shovel of FIG. 5.

As shown in FIGS. 5 and 6, the shovel 410 includes a boom 445 extending upwardly from the upper base 425. The boom 445 includes a first end 446 coupled to the upper base 425 and a second end 447 distant from the upper base 425. Further, the boom 445 includes a top area 423 and a bottom area 424. The top area 423 of the boom 445 includes two portions 423A and 423B, which are generally positioned on either side of an area where a pair of saddle blocks 421 couple a boom attachment or handle 450 to the boom 445. The bottom area 424 defines a single portion between the first end 446 and the second end 447 of the boom 445. The boom 445 illustrated in FIGS. 5-9 is a "flat bottom" boom. In other words, the bottom area 424 of the boom 445 between the first end 446 and the second end 447 has a flat surface. In other embodiments, the boom 445 can have a different form (e.g., a curved shape, etc.).

Referring to FIGS. 5 and 6, the handle 450 is pivotally and slidably coupled to the boom 445. A shipper shaft 442 extends transversely through the boom 445 and rotatably supports a pair of saddle blocks 421. An end of the handle 450 is received in the saddle blocks 421 such that the handle 450 can move translationally with respect to the saddle blocks 421 and can rotate about the shipper shaft 442, which defines a pivot axis 459 about which the handle 450 pivots. The saddle blocks 421 connect the boom handle 450 to the boom 445 and allows for secure movement of the handle 450. The operation of the shipper shaft 442 and saddle blocks 421 are described in more detail below.

Figure 5A:
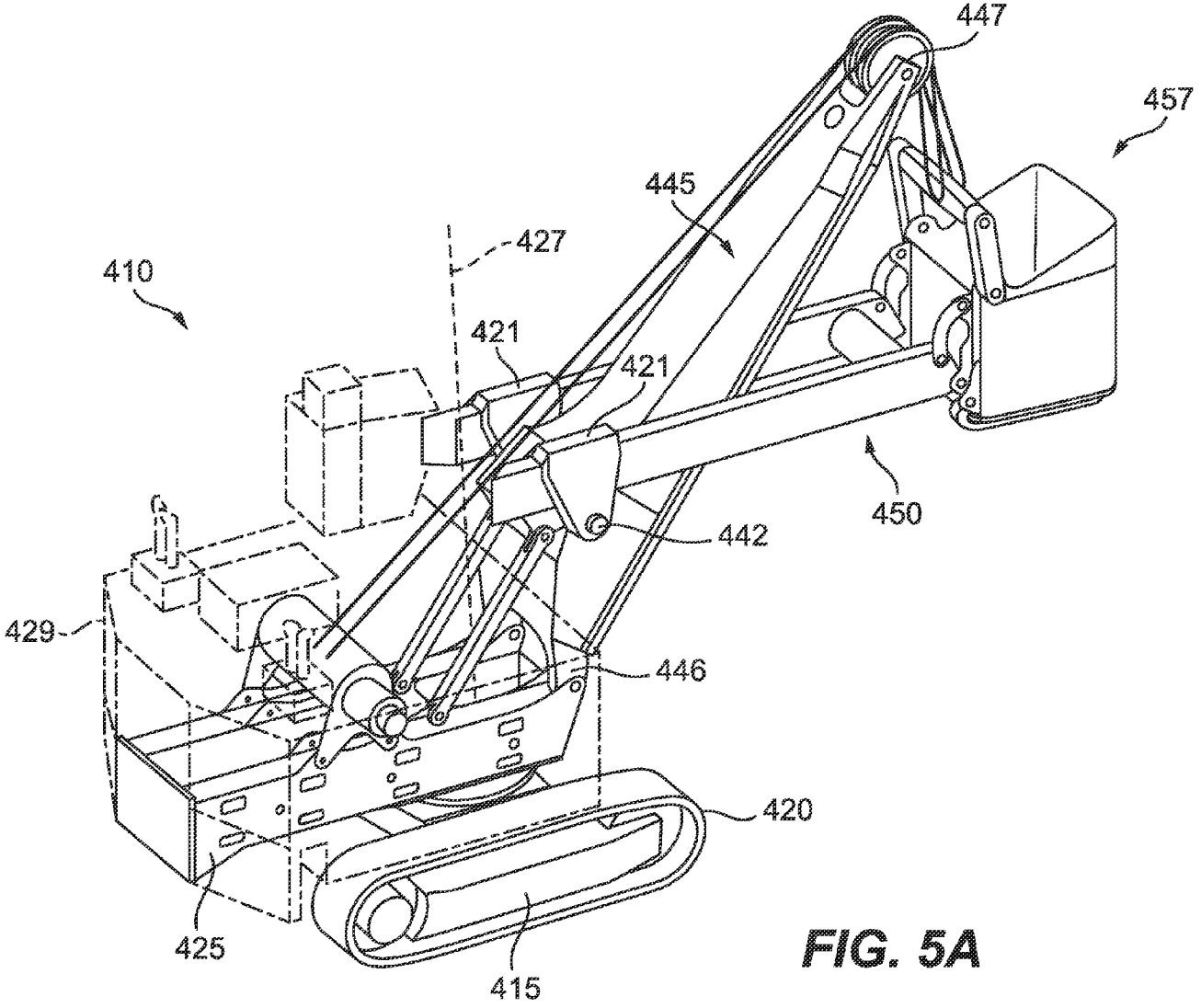
FIG. 5A is a perspective view of a shovel according to another embodiment.

The shovel 410 also includes a digging attachment coupled to another end of the boom handle 450 opposite the end that is received within the saddle blocks 421. In the embodiment of FIGS. 5 and 6, the digging attachment is a clamshell bucket 455 that is pivotably coupled to the end of the handle 450. The bucket 455 is pivoted by one or more actuators, such as hydraulic cylinders for example that are in fluid communication with a pump via one or more fluid conduits (not shown). The shovel 410 includes a mechanism 468 (FIG. 5) for supporting the fluid conduit throughout the motion of the handle 450. In the illustrated embodiment, the mechanism 468 is a hose reel that reels in and pays out fluid conduit based on the extension of the handle. The bucket 455 includes a digging edge 456 having teeth and is used to excavate the desired work area, collect material, and transfer the collected material to a desired location (e.g., a material handling vehicle). In other embodiments (FIG. 5A), the digging attachment is a dipper 457 rigidly attached to the end of the handle 450 such that the dipper 457 does not move relative to the handle 450 during a digging operation. The combination of the boom 445, the boom handle 450, and the bucket 455 define a digging assembly of the shovel 410.

Referring again to FIGS. 5 and 6, a boom sheave 460 is rotatably coupled to the second end 447 of the boom 445 similar to the manner described above with respect to FIGS. 1-3. A hoist drum 463 is coupled to the upper base 425 and is powered by a motor 487 that provides turning torque to the drum 463 through a geared hoist transmission (not shown). The hoist drum 463 reels in and pays out a hoist rope 462, which extends upwardly along the boom 445, over the boom sheave 460, and downwardly to an attachment point on the bucket 455. Rotation of the hoist drum 463 reels in and pays out the hoist rope 462, thereby raising and lowering the bucket 455, respectively.

The boom handle 450 and the bucket 455 are supported by the hoist rope 462 extending over the boom sheave 460. More specifically, a connecting mechanism 473 engages the hoist rope 462 and connects the boom handle 450 and the bucket 455 with the sheave 460. In one embodiment, the connecting mechanism 473 comprises an equalizer coupled to the bucket 455. In one embodiment, the equalizer senses the tension applied on each hoist rope 462 and is operable to equalize the tension in the hoist ropes 462. In other embodiments (for example, when hydraulic cylinders driving the bucket 455 are attached to the upper portion of the bucket 455 as described in FIG. 4), an equalizer is positioned near the pivot point of the lower arm and the bucket, and the hoist rope 462 passes between the actuators to reach the equalizer. In still other embodiments, other types of connecting mechanisms 473, such as a bail, can be used to connect the sheave 460 with the handle 450 and the bucket 455.

Referring now to FIG. 6, the first end 446 of the boom 445 is coupled to the upper base 425 via pin joints or other suitable attachment mechanisms and defines a boom pivot axis 426. In some embodiments, the boom 445 comprises a first portion 431 that extends generally upwardly from the base 425, and a second portion 432 that extends at an angle from the first portion 431 toward the second end 447. Specifically, the angle between the first portion 431 and the second portion 432 of the boom is defined between the first portion 423A and second portion 423B of the top area of the boom 445. Generally, the saddle block 421 supporting the handle 450 is positioned at an area where the first portion 423A and second portion 423B of the top area 423 intersect. A pivot axis 459 of the boom handle 450 is defined by the position of the shipper shaft 442. The area below the pivot axis 459 of the handle 450 (i.e., the area below the shipper shaft 442) has an extended diameter also referred to as an "extended belly." As described in more detail below, the extended diameter of the area below the pivot axis 459 allows for the incorporation of a three-piece saddle block 421. In one embodiment, the boom 445 comprises a one piece construction combining the first and the second portions of the boom.

As shown in FIG. 6, the first portion 431 of the boom 445 is angled with respect to the second portion 432 of the boom. Since the bottom portion 24 of the boom is flat, an angle 434 is defined between the first portion 423A and the second portion 423B of the top area of the boom 445. In the illustrated embodiment, the angle 434 is between approximately 130 degrees and approximately 140 degrees. More specifically, the angle 434 is approximately 134 degrees. In other words, the second portion 432 of the boom 445 is offset from the first portion 431 by an angle 435. In the illustrated embodiment, the angle 435 is between approximately 40 degrees and approximately 50 degrees. In particular, the offset angle 435 is approximately 46 degrees.

The described flat bottom boom 445 provides improved support for the handle 450 during swing load operations in the tuck back position of the shovel 410. Additional support to the handle 450 is provided by guide rails 441 (FIG. 6) that can extend further outwardly from the boom 445 parallel to the pivot axis 459 of the handle 450. Therefore, the flat bottom geometry of the boom 445 creates additional support and allows the proposed design to eliminate weight from the handle 450.

Figure 7:
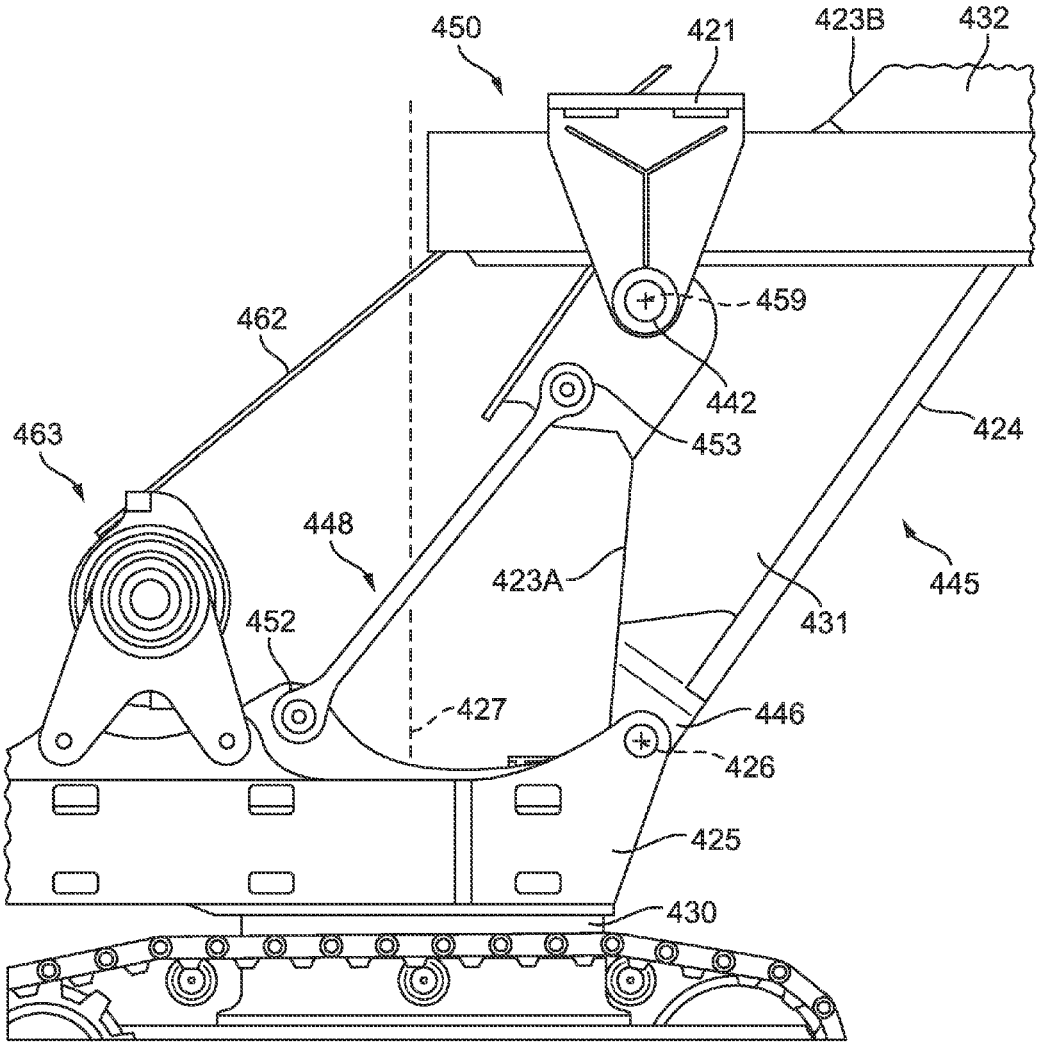
FIG. 7 is a side view of a portion of the shovel of FIG. 5.
Figure 8:
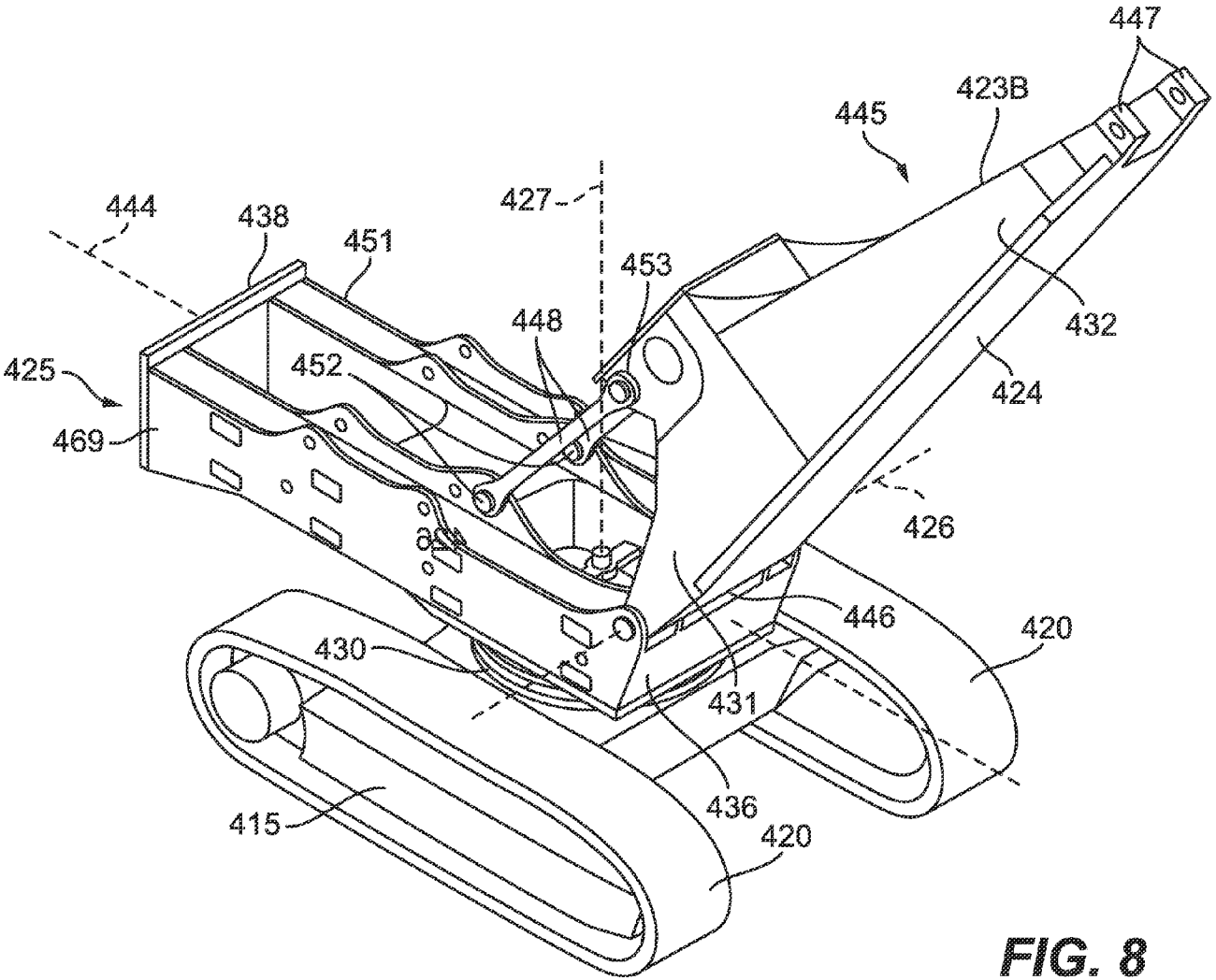
FIG. 8 is a perspective view of a base, boom, and support member.
Figure 9:
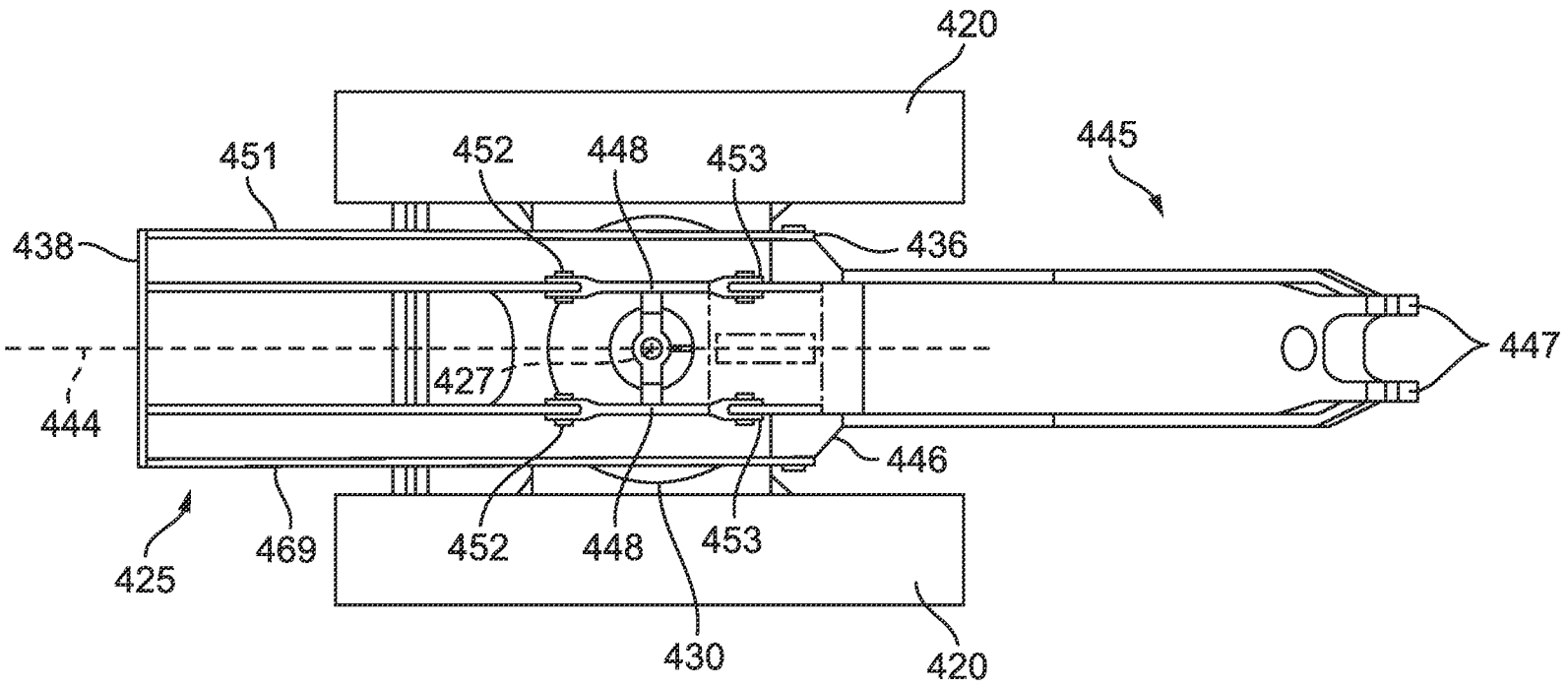
FIG. 9 is a top view of the base, boom, and support member of FIG. 8.
Figure 10:
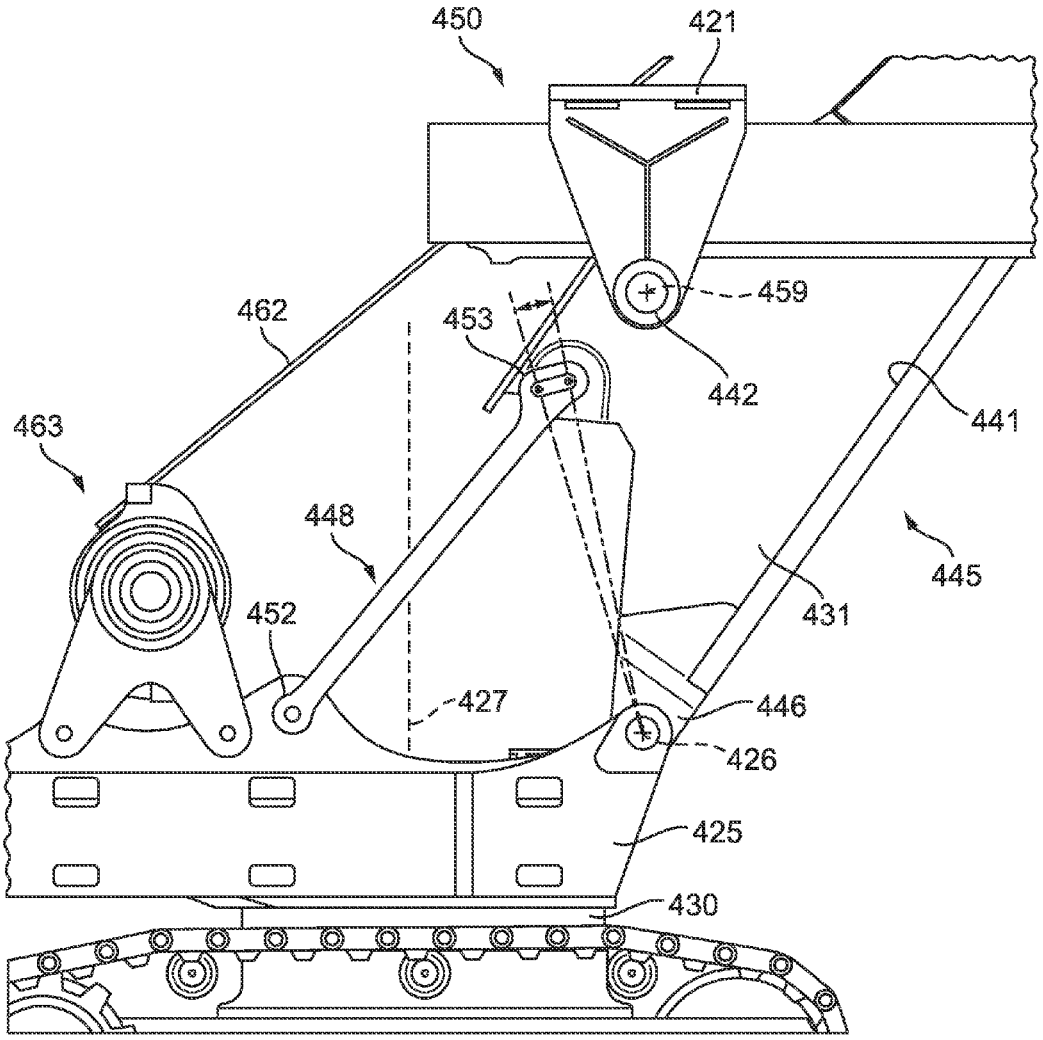
FIG. 10 is a side view of a portion of a shovel according to another embodiment.

As shown in FIGS. 7-9, the shovel 410 also includes a support member in the form of a pair of struts 448 for supporting the boom 445 in an upright position relative to the base 425. In the illustrated embodiment, the struts 448 are positioned parallel to one another and are not connected to each other. In other embodiments, the struts 448 are coupled by rigid-connect members (not shown).

As shown in FIG. 7, each strut 448 includes a first end 452 coupled to the upper base 425 at a location between the hoist drum 463 and the first end 446 of the boom 445. Each strut 448 also includes a second end 453 coupled to a depending portion of the boom 445. In the illustrated embodiment, the struts 448 are positioned forward of the hoist drum 463. In other embodiments, the first end 452 of each strut 448 can extend behind the hoist drum 463. The second end 453 of each strut 448 is rigidly coupled to the general area where the first portion 431 and the second portion 432 of the boom 445 connect or intersect.

As best shown in FIGS. 8 and 9, the struts 448 straddle the axis of rotation 427, and the couplings between the first ends 452 and the upper base 425 are positioned on an opposite side of the axis 427 from the boom 445. More specifically, the upper base 425 defines a first or front end 436 proximate the first end 446 of the boom 445 and a second or rear end 438 opposite the front end 436. A frame axis 444 extends from the front end 436 to the rear end 438. The base 425 also includes a first or left side 451 extending generally parallel to and offset from the frame axis 444, and a second or right side 469 parallel to the left side 451 and positioned on an opposite side of the frame axis 444. In general, the area of the base 425 between the axis of rotation and the front end 436 is a front portion, while the area between the axis of rotation 427 and the rear end 438 is a rear portion. Also, the area of the base 425 between the axis of rotation 427 and the left side 451 is a left portion, and the area between the axis of rotation 427 and the right side 469 is a right portion. One of the first ends 452 of the struts 448 is positioned proximate the left side 451 in the left portion, while the other first end 452 is positioned proximate the right side 469 in the right portion. In addition, the first ends 452 are coupled to the base 425 proximate the rear end 438 (i.e., in the rear portion), while the first end 446 of the boom 445 is coupled to the base 425 proximate the front end 436 (i.e., in the front portion). Therefore, the main support points for the boom 445 (i.e., the first ends 452 of the struts 448 and the first end 446 of the boom 445) are generally positioned around the axis of rotation 427, providing a more even load distribution on the base 425 and the rotation mechanism 430. This improves the load flow of the bucket 455 through the boom 445 and struts 448, providing a direct path through the rotational structure 430 and reduces the bending stress in the frame 425.

The position of the struts 448 provides greater stability of the boom 45 and also allows easier access to the hoist drum 463 (FIG. 7) and the other machinery elements of the shovel 410 when maintenance is required. Specifically, positioning the struts 48 forward of the hoist drum 463 allows the hoist drum 463 to be easily accessed from the top of the shovel 410 (e.g., by a crane). The struts 448 eliminate the need for a gantry structure, a major structural member of conventional shovels that generally includes a compression member, a tension member, and suspensions ropes for supporting the boom 445. Further, the struts 448 eliminate the need for a separate boom stabilizer in compression.

In some embodiments, the struts 448 are pivotally connected to the upper base 425 and to the boom 445 via moving pin joints or other types of connectors. The struts 448 can be provided with shock absorbing connectors such as various types of spring assemblies and/or fluid dampers incorporated into the pinned attachment joints between the struts 448, the upper base 425, and the boom 445. These shock absorbing connectors reduce the overall stiffness of the strut assembly when compression and tension forces are acting on the strut 448, thereby reducing shock loading and in turn reducing the overall stresses experienced by the various components and the major structures.

Figure 11:
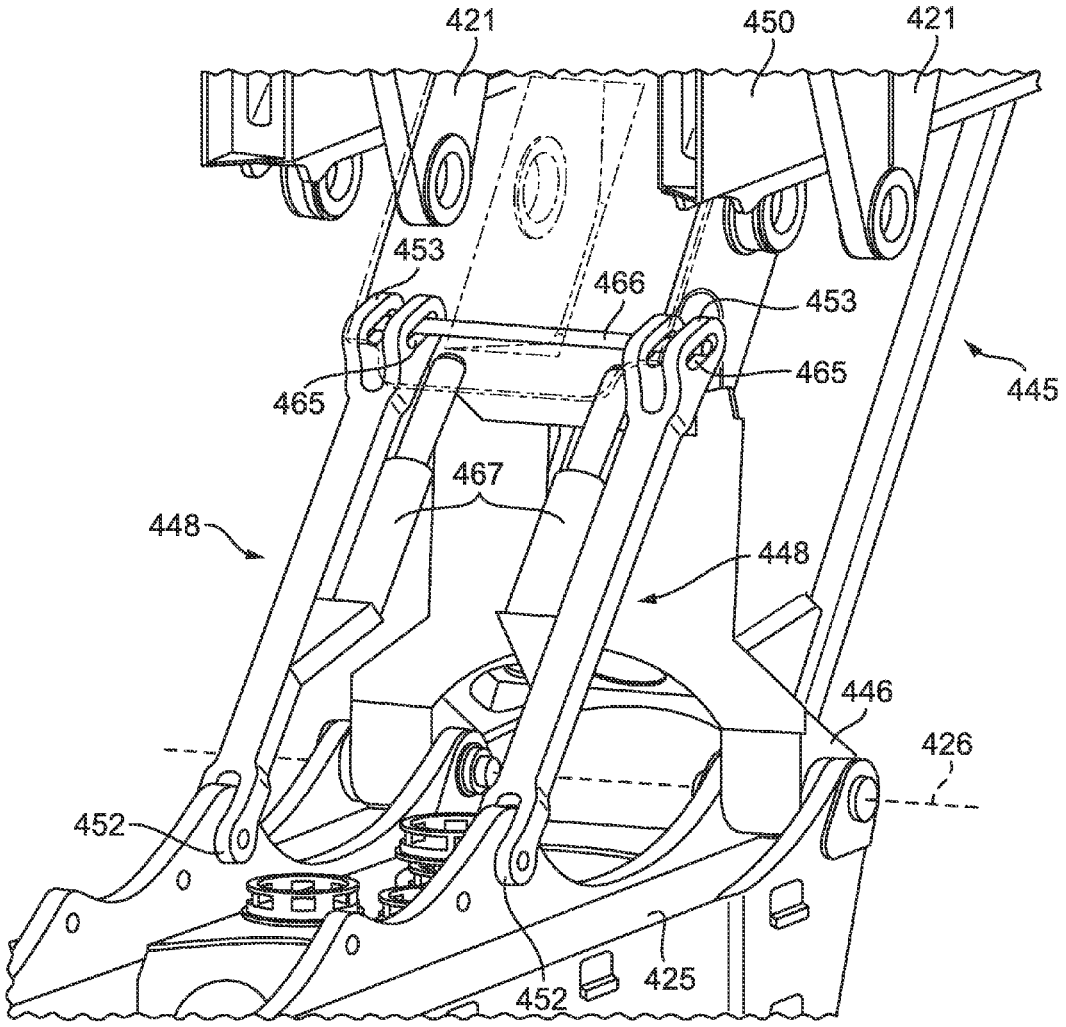
FIG. 11 is a rear perspective view of a portion of the shovel of FIG. 10.
Figure 12:
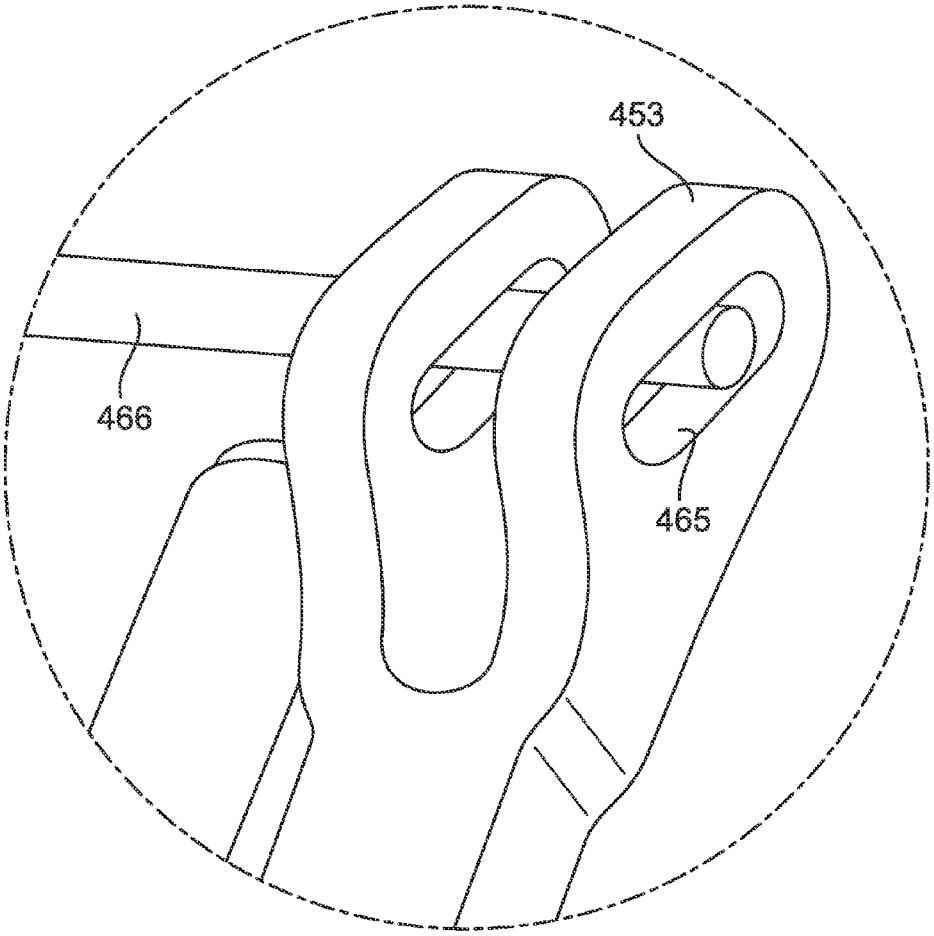
FIG. 12 is an enlarged perspective view of a coupling between a strut and a boom.
Figure 13:
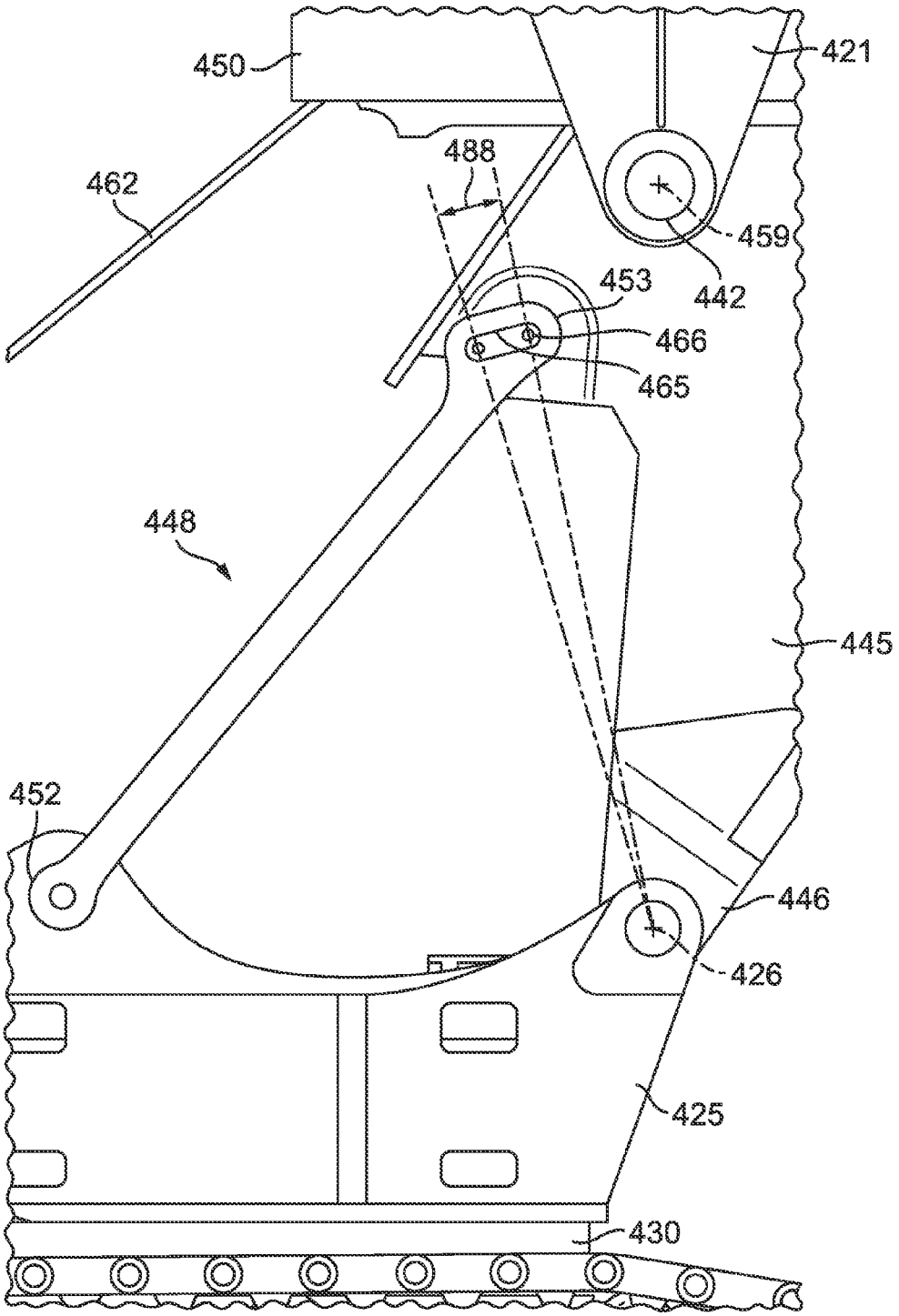
FIG. 13 is an enlarged side view of the portion of the shovel of FIG. 11.
Figure 14:
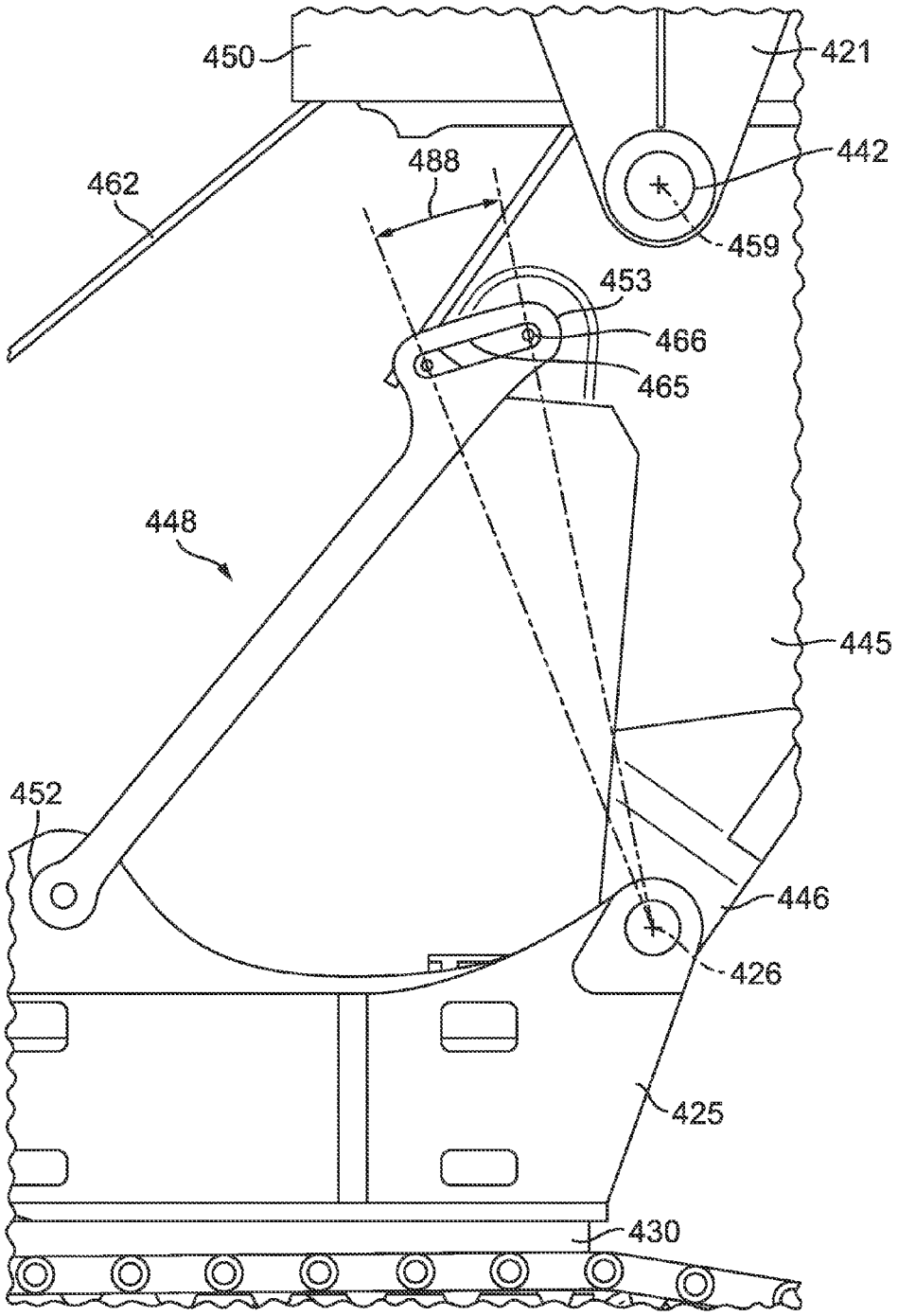
FIG. 14 is an enlarged side view of a portion of a shovel according to another embodiment.

In the embodiment shown in FIGS. 10-13, the strut 448 is movably connected to the boom 445 by a sliding pin joint. As shown in FIGS. 11 and 12, the strut 448 includes a slot 465 that receives a pin 466 coupled to the boom 445. The sliding pin joint permits the boom 445 to pivot relative to the base 425 toward the axis of rotation 427 (counter-clockwise in FIG. 13). The slot 465 permits the boom 445 to pivot within a predetermined angular range 488, and the slot 465 provides an ultimate stop for the pivoting movement. In the illustrated embodiment, the slot 465 is sized so that the boom 445 can pivot through an angle 488 of five degrees. In another embodiment, shown in FIG. 14, the slot 465 is sized so that the boom 445 can pivot through an angle 488 of ten degrees.

Referring again to FIG. 11, the pivoting movement of the boom 445 is dampened by fluid dampers 467 coupled between the strut 448 and the boom 445. In the illustrated embodiment, the fluid dampers 467 are pressurized cylinders. Each cylinder includes a relief valve (not shown) that opens when the force on the cylinder exceeds a predetermined level to permit the boom 445 to pivot toward the axis of rotation 427 (i.e., counter-clockwise in FIG. 13). In addition, the cylinders are double-acting so that the cylinders dampen the movement of the boom 445 as it pivots back toward its normal position (i.e., clockwise in FIG. 13) after the overload event. In one embodiment, the relief valves do not open until the force exerted on the boom 445 exceeds a maximum allowable dynamic impact load, and a signal or alarm is transmitted to a control system when the relief valves open.

Figure 15:
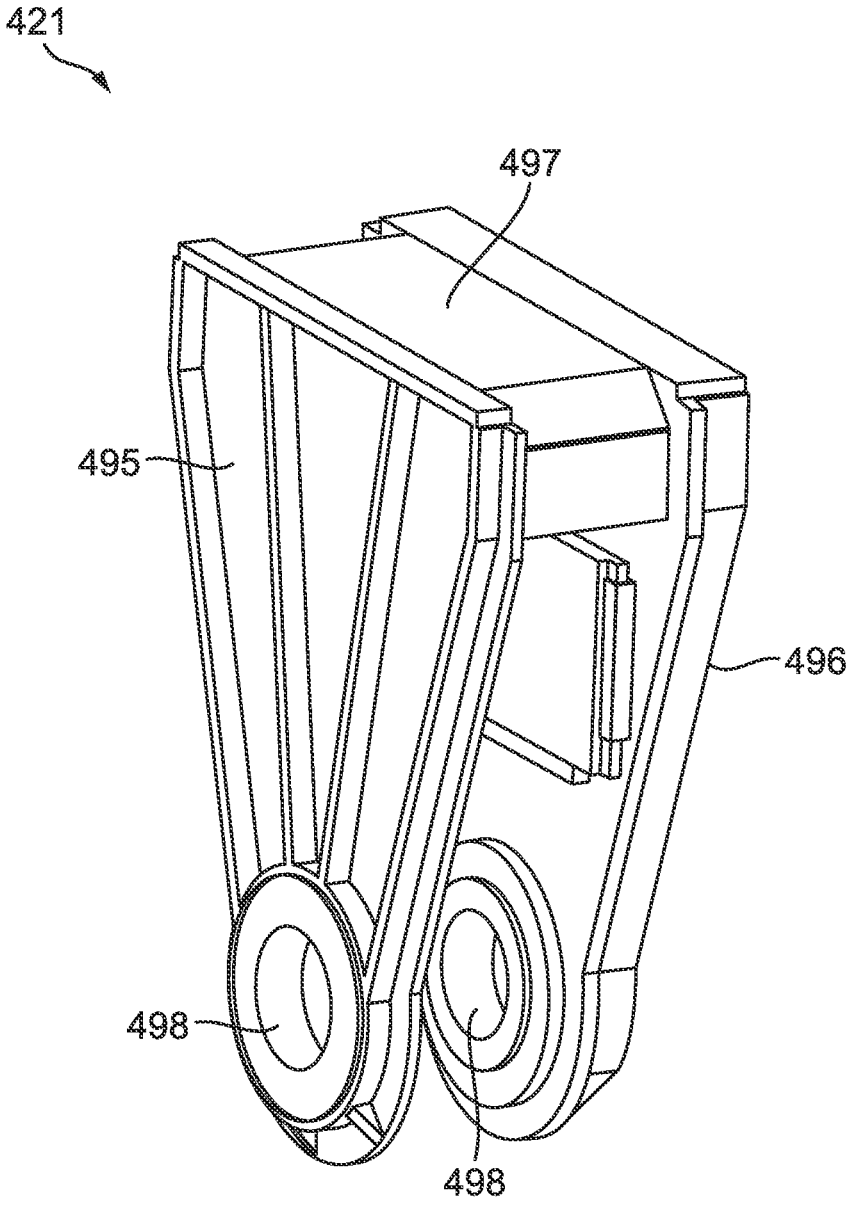
FIG. 15 is a perspective view of a saddle block.
Figure 16:
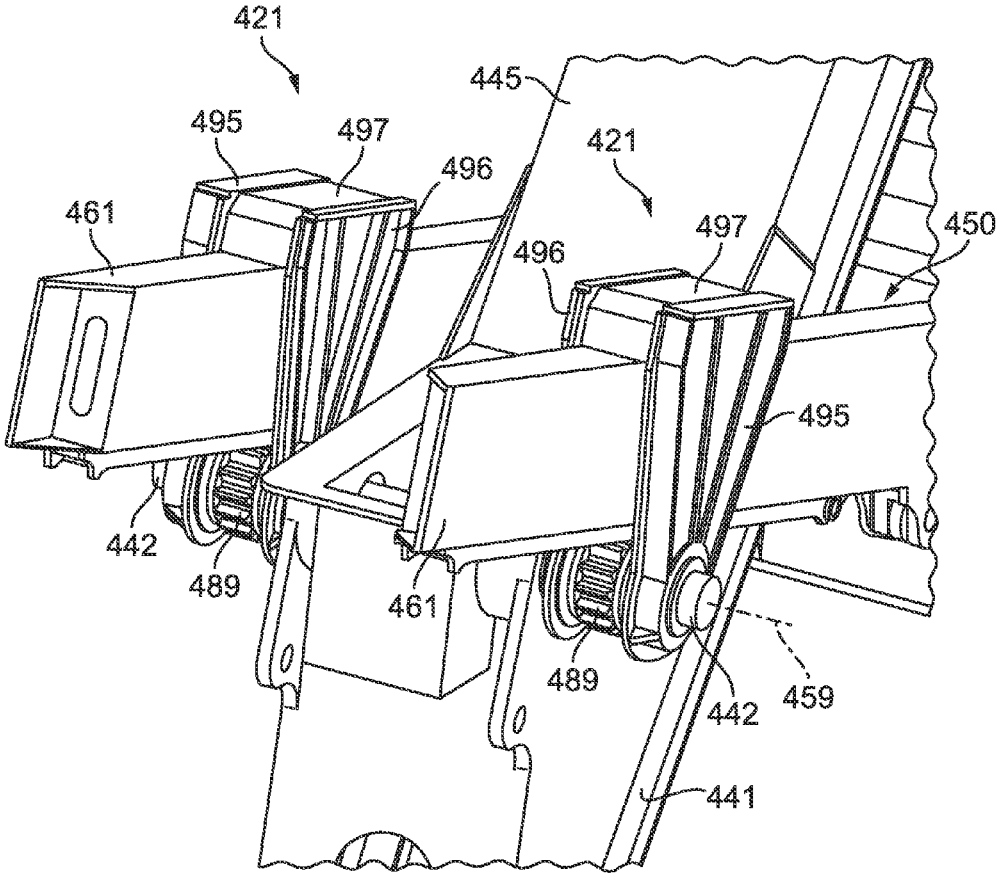
FIG. 16 is a rear perspective view of the saddle block of FIG. 15 coupled to the boom and supporting a handle.

The three-piece saddle block 421 is shown in FIGS. 15 and 16. The saddle block 421 includes a first side portion 495, a second side portion 496 parallel to the first side portion 495, and a top portion 497 connecting the two side portions 495 and 496. Each of the side portions 495 and 496 includes an aperture 498, both of which are aligned with one another. The shipper shaft 442 or another mechanism extends through the apertures 498 to pivotally support the handle 450 that is connected to the boom 445. As illustrated in FIG. 16, the shovel 410 includes two saddle blocks 421 coupled to the boom 445 for receiving an end of the handle 450. Pinion gears 489 are coupled to the shipper shaft 442 and positioned between the side portions 495, 496 of each saddle block 421. The pinion gears 489 engage a rack (not shown) on each handle member 461 to extend and retract the handle 450.

As described above, the area below the pivot axis 459 of the boom 445 has an extended diameter (i.e., "extended belly"). The extended diameter of the area below the pivot axis 459 allows for the incorporation of the saddle block 421. Specifically, the saddle block 421 rotates without hitting the guide rail 441 (FIG. 16). This permits a more compact and lighter design of the shovel 410 and also allows for easier removal of the saddle block 421 (as compared to a two-piece saddle block).

Figure 17:
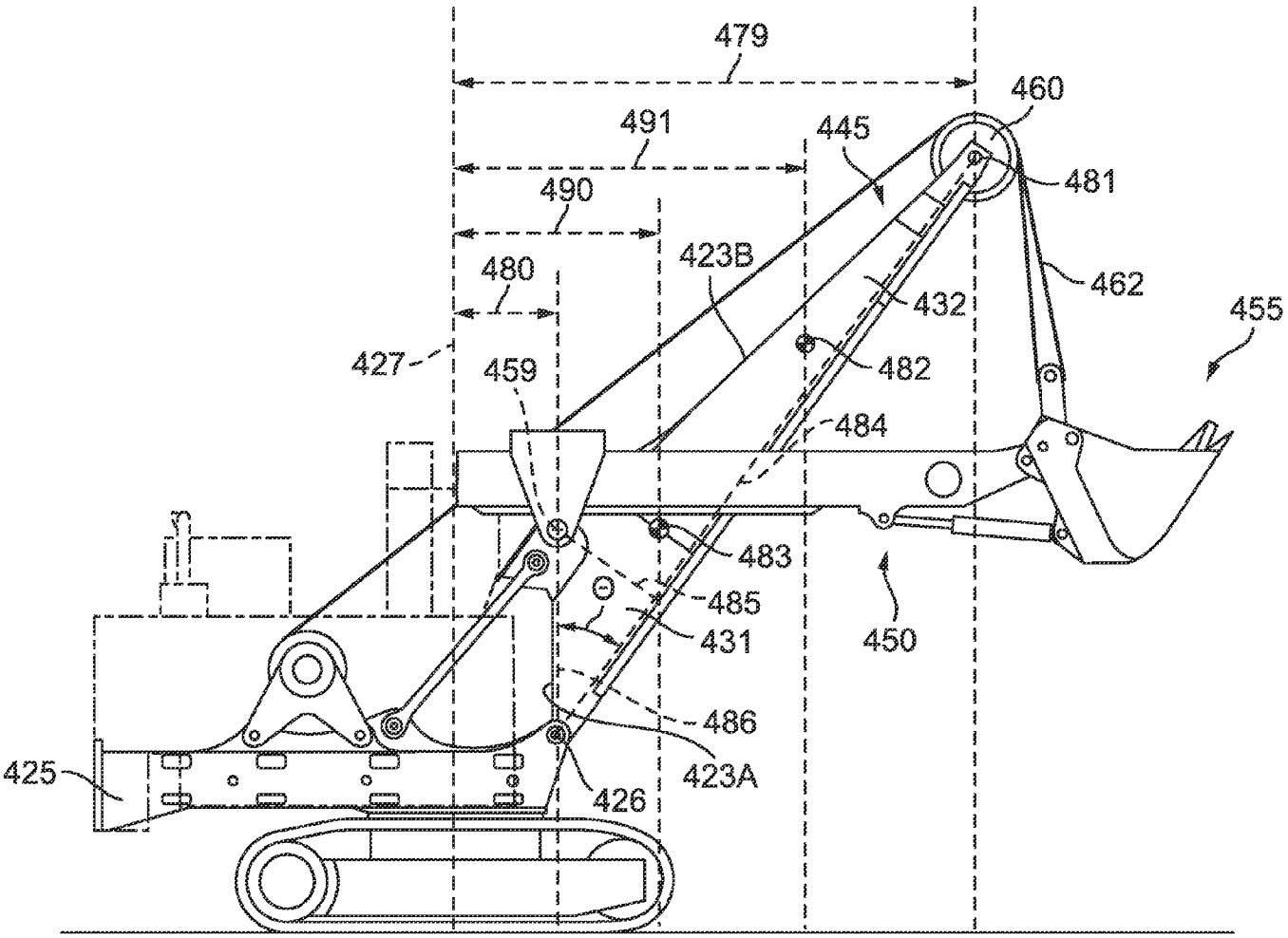
FIG. 17 is a side view of the shovel of FIG. 5 illustrating relative locations of centers of gravity of certain components of the shovel.

Referring now to FIG. 17, the boom 445 includes a pivot element or pivot axis 459 (e.g., defined by the shipper shaft 442 or a pin depending on the type of handle 450) that pivotally supports the handle 450. The pivot axis 459 of the flat bottom boom 445 is located significantly closer to the axis of rotation 427 of the shovel 410 when compared to the pivot axis location for a conventional straight boom. For example, in some embodiments, the pivot axis 459 is about nine feet closer to the axis of rotation 427 than it would be if the boom 445 was a conventional straight boom. Thus, the maximum reach of the bucket 455 is closer to the base 425 and to the center line of rotation 427 when compared to the reach of a conventional dipper. Therefore, a center of gravity 483 of the boom 445 is also closer to the axis of rotation 427 than the center of gravity of a conventional boom. Consequently, less counterweight is required to support the digging attachment and the overall machine weight and swing inertia is reduced.

In some embodiments, the pivot axis 459 of the handle 450 is positioned approximately where the first portion 423A and the second portion 423B of the top area of the boom 445 connect or intersect. In some embodiments, the pivot axis 459 is positioned substantially directly above a point of connection 426 between the first portion 431 of the boom 445 and the upper base 425. For example, depending on the particular construction of the boom 445, the pivot axis 459 can be positioned up to approximately 10 degrees in either direction from a vertical line drawn directly upwardly from the boom pivot axis 426. In other embodiments, the pivot axis 459 can be positioned up to approximately 5 degrees in either direction from a vertical line drawn upwardly from the boom pivot axis 426.

The geometry of the boom 445 and the configuration of the saddle block 421 causes the pivot axis 459 of the handle 450 to be positioned substantially towards the upper base 425 and toward the axis of rotation 427 of the shovel 410. The relationship of different points along the boom 445 relative to the axis of rotation 427 and relative to one another are illustrated in and discussed with respect to FIG. 17. The relevant points or locations along the boom 445 include the pivot axis 459, the center of gravity 483 of the boom 445, a geometric center 482 of the second boom portion 432, and a boom sheave connection point 481 where the boom sheave 460 is rotatably coupled to the second boom portion 432. A boom sheave reference distance 479 is defined as a perpendicular distance from the axis of rotation 427 to the boom sheave connection point 481. A pivot axis distance 480 is defined as a perpendicular distance from the axis of rotation 427 to the pivot axis 459. A CG distance 490 is defined as a perpendicular distance from the axis of rotation 427 to the center of gravity 483 of the boom 445. A second portion center distance 491 is defined as a perpendicular distance from the axis of rotation 427 to the geometric center 482 of the second boom portion 432.

In the illustrated embodiment, the pivot axis distance 480 is between approximately 18 percent and approximately 40 percent of the boom sheave reference distance 479. For example, the pivot axis distance 480 is approximately 19.7 percent of the boom sheave reference distance 479. In other embodiments the pivot axis distance 480 is between approximately 25 percent and approximately 35 percent of the boom sheave reference distance 479. In still other embodiments the pivot axis distance 480 is approximately thirty percent of the boom sheave reference distance 479.

In the illustrated embodiment, the CG distance 490 is between approximately 35 percent and approximately 55 percent of the boom sheave reference distance 479. For example, the CG distance 490 is approximately 43.7 percent of the boom sheave reference distance 479. In other embodiments the CG distance 490 is between approximately 40 percent and approximately 50 percent of the boom sheave reference distance 479. In still other embodiments the CG distance 490 is approximately 45 percent of the boom sheave reference distance 479.

In the illustrated embodiment, the second portion center distance 491 is between approximately 55 percent and approximately 75 percent of the boom sheave reference distance 479. For example, the second portion center distance 491 is approximately 62 percent of the boom sheave reference distance 479. In other embodiments the second portion center distance 491 is between approximately 60 percent and approximately 70 percent of the boom sheave reference distance 479. In still other embodiments the second portion center distance 491 is approximately 65 percent of the boom sheave reference distance 479.

With continued reference to FIG. 17, a boom longitudinal axis or reference line 484 extends between the boom pivot axis 426 (i.e., the point of connection between the first portion 431 of the boom 445 and the upper base 425) and the boom sheave connection point 481. A reference distance 485 is defined as the perpendicular offset of the pivot axis 459 with respect to the reference line 484 (i.e., a distance measured from the pivot axis 459 to the reference line 484 in a direction perpendicular to the reference line 484). In some embodiments, the length of reference line 485 is between approximately ¼ and approximately ⅛ of the length of reference line 484. In other embodiments the length of reference line 485 is between approximately ⅕ and approximately ⅐ of the length of reference line 484. In still other embodiments the length of reference line 485 is approximately ⅙ of the length of reference line 484. For example, in the illustrated embodiment the length of reference line 485 is approximately 0.1587 of the length of reference line 484.

Reference line 486 extends from boom pivot axis 426 to the pivot axis 459. In some embodiments, an angle θ between reference line 486 and reference line 484 is greater than approximately 10 degrees. In other embodiments, the angle θ is greater than approximately 20 degrees. In still other embodiments, the angle θ is greater than approximately 30 degrees. For example, in the illustrated embodiment the angle θ between reference line 486 and reference line 484 is approximately 34.5 degrees.

Thus, the features of the flat bottom boom 445 increase dig forces by as much as to 15% compared to the shovel having a straight boom. Specifically, the height of the pivot axis 459 in relation to the plane 428, the position of the boom sheave connection point 481 relative to the pivot axis 459, and the length of the handle 450 help to increase the dipper dig forces. This increase in digging force and efficiency allows manufacturers to downsize the hoist motor and the drive train of the shovel 410, thereby lowering the cost of the shovel 410. Alternatively, the size and payload of the bucket 455 can be increased while maintaining the cutting force at the teeth 456.

Due to the shape of the boom 445 and the pivot axis 459 moved closer to the axis of rotation 427, the shovel 410 significantly improves the direct line of sight of the shovel operator who wants to view parked dump trucks as he or she swings the shovel to side opposite to the operator's area 433 (FIG. 5)—that is, the operator's blind side. Compared to the conventional boom, the boom 445 is shifted above and behind the line of sight of the operator, allowing the operator to more easily position a full bucket 455 over a waiting truck or haulage vehicle. Further, the positioning of the boom 445 opens up the area in front and below the boom 445 for greater bucket 455 accommodation in tuck-back areas.

Thus, the invention provides, among other things, a mining shovel. Although the invention has been described in detail with reference to certain preferred embodiments, variations and modifications exist within the scope and spirit of one or more independent aspects of the invention as described. Various features and advantages of the invention are set forth in the following claims.

What is claimed is:

1. A mining shovel comprising:

a base including a first portion and a second portion, the first portion including tracks for supporting the shovel on a support surface, the second portion being rotatable relative to the first portion about an axis of rotation;

a boom including a first end pivotably coupled to the second portion of the base and a second end positioned away from the base, the boom being pivotable about a pivot axis extending transversely to the boom proximate the first end;

an elongated member movably coupled to the boom, the elongated member being pivotable relative to the boom and supported with respect to the boom between the first end and the second end of the boom; and a support member for biasing the boom against pivoting movement about the pivot axis in a first direction and in a second direction opposite the first direction, the support member including a pair of struts, each strut positioned on an opposite side of the axis of rotation and including a first end coupled to the second portion of the base and a second end coupled to the boom.

2. The mining shovel of claim 1, wherein the boom is coupled to the second portion of the base on one side of the axis of rotation and the first end of each strut is coupled to the second portion on an opposite side of the axis of rotation from the first end of the boom.

3. The mining shovel of claim 2, wherein the second portion of the base includes a first end, a second end, a first side, and a second side, wherein the boom is coupled to the second portion proximate the first end and the first end of each strut is coupled to the second portion proximate the second end, and wherein one of the strut first ends is coupled to the second portion proximate the first side and the other of the strut first ends is coupled to the second portion proximate the second side.

4. The mining shovel of claim 3, wherein a frame axis extends between the first end and the second end perpendicular to the axis of rotation, wherein the first side is laterally offset from the frame axis in a first direction and the second side is laterally offset from the frame axis in a second direction.

5. The mining shovel of claim 1, wherein the boom includes a pin extending outwardly from the boom, and wherein the support member includes a first end coupled to the base and a second end coupled to the boom, the second end including a slot for receiving the pin, wherein rotation of the boom about the pivot axis causes the pin to move within the slot.

6. The mining shovel of claim 1, wherein the support member further includes a damper coupled between the strut and the boom.

7. The mining shovel of claim 6, wherein the damper includes a pressurized fluid cylinder, the cylinder including a relief valve that is movable to an open state when a force exerted on the boom exceeds a maximum allowable load.

8. The mining shovel of claim 6, wherein the boom pivots about the pivot axis in a first direction and a second direction opposite the first direction, and wherein the damper dampens movement of the boom in the first direction and the second direction.

9. The mining shovel of claim 1, further comprising a bucket supported for pivoting movement on an end of the elongated member.

10. The mining shovel of claim 9, further comprising a hoist drum for winding up or paying out a hoist rope, the hoist rope extending over the second end of the boom and being coupled to the bucket.

11. A mining shovel comprising:

a base for supporting the shovel on a support surface;

a boom including a first end coupled to the base by a pin connection and a second end positioned away from the base, the pin connection defining a pin axis extending transversely to the boom proximate the first end;

an elongated member movably coupled to the boom, the elongated member being pivotable about a shaft positioned between the first end and the second end of the boom; and a support member for biasing the boom against pivoting movement about the pin axis in a first direction and in a second direction, the support member extending between the base and the boom.

12. The mining shovel of claim 11, wherein the base includes a first portion and a second portion that is rotatable relative to the first portion about an axis of rotation, wherein the boom is coupled to the second portion on one side of the axis of rotation and the support member is coupled to the second portion on an opposite side of the axis of rotation from the first end of the boom.

13. The mining shovel of claim 12, wherein the support member includes a pair of struts, wherein the struts are positioned on opposite sides of the axis of rotation such that the struts straddle the axis of rotation.

14. The mining shovel of claim 11, wherein the boom including a pin extending in a direction parallel to the pin axis, and wherein the support member includes a first end coupled to the base and a second end coupled to the boom, the second end including a slot for receiving the pin, wherein rotation of the boom about the pin axis causes the pin to move within the slot.

15. The mining shovel of claim 11, wherein the support member includes a strut and a damper, the strut having a first end coupled to the base and a second end coupled to the boom, damper coupled between the strut and the boom.

16. The mining shovel of claim 15, wherein the damper includes a pressurized fluid cylinder, the cylinder including a relief valve that is movable to an open state when a force exerted on the boom exceeds a maximum allowable load.

17. The mining shovel of claim 15, wherein the boom pivots about the pin axis in a first direction and a second direction opposite the first direction, and wherein the damper dampens movement of the boom in the first direction and the second direction.

18. The mining shovel of claim 11, wherein the shaft extends transversely through the boom and the mining shovel further comprises a saddle block rotatably coupled to the shaft, the saddle block including a first side, a second side parallel to the first side, and a top portion extending between the first side and the second side.

19. The mining shovel of claim 11, further comprising a bucket supported for pivoting movement on an end of the elongated member.

20. The mining shovel of claim 19, further comprising a hoist drum for winding up or paying out a hoist rope, the hoist rope extending over the second end of the boom and being coupled to the bucket.

21. The mining shovel of claim 11, wherein the boom includes a first portion proximate the first end and a second portion proximate the second end, the second end being oriented at an angle relative to the first portion.

22. The mining shovel of claim 21, wherein the angle between the first portion and the second portion is between approximately 130 degrees and approximately 140 degrees.

23. The mining shovel of claim 11, wherein the shaft defines a pivot axis about which the elongated member pivots, wherein the boom defines a longitudinal axis extending from the first end of the boom to the second end of the boom, and wherein a reference line extends between the pivot axis and the pin axis, wherein an angle between the reference line and the longitudinal axis is greater than ten degrees.

24. The mining shovel of claim 11, wherein the shaft defines a pivot axis about which the elongated member pivots, wherein the boom defines a longitudinal axis extending from the first end of the boom to the second end of the boom, the distance between the first end of the boom and the second end of the boom defining a boom length, and wherein the pivot axis is offset from the longitudinal axis by a perpendicular offset distance, a ratio of the perpendicular offset distance to the boom length being between approximately 1:8 and approximately 1:4.

25. The mining shovel of claim 11, wherein the support member prevents any movement of the boom about the pin axis in a first direction and in a second direction opposite the first direction.

26. The mining shovel of claim 11, wherein the support member includes at least one rigid strut including a first end and a second end, the first end of each strut directly coupled to the base, the second end of each strut directly coupled to the boom.

27. The mining shovel of claim 11, wherein the support member includes a rigid strut directly coupled to the boom such that no support cables extend between the strut and the boom.

28. The mining shovel of claim 17, wherein the support member includes a first end and a second end, the first end coupled to the base, the second end coupled to the boom between the first end of the boom and the second end of the boom.

29. The mining shovel of claim 1, wherein the support member prevents any movement of the boom about the pivot axis in the first direction and in the second direction.

30. The mining shovel of claim 1, wherein each strut includes a unitary, rigid member, the first end of each strut directly coupled to the second portion of the base, the second end of each strut directly coupled to the boom.

31. The mining shovel of claim 1, wherein the second end of each strut is directly coupled to the boom such that no support cables extend between the support member and the boom.

32. The mining shovel of claim 1, wherein the second end of each strut is coupled to the boom between the first end of the boom and the second end of the boom.

33. The mining shovel of claim 32, wherein elongated member is pivotable relative to the boom about a shipper shaft, and wherein the second end of each strut is coupled to the boom between the first end of the boom and the shipper shaft.

34. A mining shovel comprising:

a base for supporting the shovel on a support surface;

a boom including a first end pivotably coupled to the base and a second end positioned away from the base, the boom being pivotable about a boom pivot axis extending transversely to the boom proximate the first end;

an elongated member movably coupled to the boom, the elongated member being pivotable about a shaft positioned between the first end and the second end of the boom; and a support member for biasing the boom against pivoting movement about the boom pivot axis, the support member extending between the base and the boom, wherein the support member includes a strut and a damper, the strut having a first end coupled to the base and a second end coupled to the boom, the damper coupled between the strut and the boom.

35. The mining shovel of claim 34, wherein the base includes a first portion and a second portion that is rotatable relative to the first portion about an axis of rotation, wherein the boom is coupled to the second portion on one side of the axis of rotation and the first end of the strut is coupled to the second portion on an opposite side of the axis of rotation from the first end of the boom.

36. The mining shovel of claim 35, wherein the support member includes a pair of struts, wherein the struts are positioned on opposite sides of the axis of rotation such that the struts straddle the axis of rotation.

37. The mining shovel of claim 34, wherein the damper includes a pressurized fluid cylinder, the cylinder including a relief valve that is movable to an open state when a force exerted on the boom exceeds a maximum allowable load.

38. The mining shovel of claim 34, wherein the boom including a pin extending in a direction parallel to the boom pivot axis, and wherein the second end of the strut includes an elongated slot for receiving a portion of the pin, the elongated slot extending in a direction transverse to the pin such that the pin can move within the elongated slot when the boom pivots about the boom pivot axis through a predetermined angular range.

39. The mining shovel of claim 34, wherein the boom pivots about the boom pivot axis in a first direction and a second direction opposite the first direction, and wherein the damper dampens movement of the boom in at least one of the first direction and the second direction.

* * * * *